US011409243B2

(12) United States Patent
Behrend et al.

(10) Patent No.: US 11,409,243 B2
(45) Date of Patent: Aug. 9, 2022

(54) TIMEPIECE TRANSMISSION COUPLING

(71) Applicant: ROLEX SA, Geneva (CH)

(72) Inventors: Raoul Behrend, Nyon (CH); Blaise Fracheboud, Plan-les-Ouates (CH); Ludovic Zbylut, Poisy (FR)

(73) Assignee: ROLEX SA, Geneva (CH)

( * ) Notice: Subject to any disclaimer, the term of this patent is extended or adjusted under 35 U.S.C. 154(b) by 846 days.

(21) Appl. No.: 16/027,652

(22) Filed: Jul. 5, 2018

(65) Prior Publication Data

US 2019/0011886 A1 Jan. 10, 2019

(30) Foreign Application Priority Data

Jul. 6, 2017 (EP) ..... 17179976
Jul. 6, 2017 (EP) ..... 17179985

(51) Int. Cl.
*G04B 13/02* (2006.01)

(52) U.S. Cl.
CPC ..... *G04B 13/021* (2013.01)

(58) Field of Classification Search
CPC ..... G04B 13/021; G04B 13/00; G04B 13/02
See application file for complete search history.

(56) References Cited

U.S. PATENT DOCUMENTS 1,345,766 A 7/1920 Hammond
2,491,453 A 12/1949 Knobel
5,018,118 A 5/1991 Ross
6,517,439 B1 2/2003 Sears
8,282,271 B2 10/2012 Kressmann et al.
2003/0232653 A1 12/2003 Kirschey
2010/0290321 A1 11/2010 Martinez et al.
2011/0013496 A1 1/2011 Kressmann et al.
2011/0038233 A1 2/2011 Martinez et al.
2012/0092967 A1 4/2012 Courvoisier et al.

FOREIGN PATENT DOCUMENTS

CN 1227894 A 9/1999
CN 205605671 U 9/2016
DE 195 43 187 A1 5/1997
(Continued)

OTHER PUBLICATIONS

European Search Report and Written Opinion dated Jan. 31, 2018 issued in counterpart application No. EP17179976; w/ English machine translation (21 pages).
(Continued)

*Primary Examiner* — Edwin A. Leon
*Assistant Examiner* — Jason M Collins
(74) *Attorney, Agent, or Firm* — WHDA, LLP

(57) ABSTRACT

A transmission coupling (100), especially a timepiece transmission coupling, for the mechanical linkage of at least one first part (2A) of a first shaft at least movable in rotation about a first axis (A2) to at least one second part (3A) of a second shaft at least movable in rotation about a second axis (A3), the first and second axes being parallel or substantially parallel, the transmission coupling including the at least one first part (2A), the at least one second part (3A), and at least a first elastic return system (15, 16; 18; 16*a*'-16*d*'; 111*a*, 111*b*; 221, 222, 223, 224) arranged so as to limit or cancel out the play between the at least one first part (2A) and the at least one second part (3A), and connecting the at least one first part (2A) and the at least one second part (3A).

20 Claims, 20 Drawing Sheets

(56) References Cited

FOREIGN PATENT DOCUMENTS

| | | | |
|---|---|---|---|
| DE | 20 2008 005 907 | U1 | 9/2009 |
| DE | 10 2011 122 868 | A1 | 3/2013 |
| EP | 2 085 833 | A1 | 8/2009 |
| EP | 2 189 675 | A1 | 5/2010 |
| EP | 2 275 883 | A1 | 1/2011 |
| EP | 2 442 191 | A1 | 4/2012 |
| JP | 2-21029 | A | 1/1990 |
| JP | 2004-52795 | A | 2/2004 |

OTHER PUBLICATIONS

European Search Report and Written Opinion dated Feb. 2, 2018 issued in counterpart application No. EP17179985; w/ English machine translation (20 pages).

Office Action dated Jan. 18, 2021, issued in counterpart CN application No. 201810731936.X, with English translation. (26 pages).

TIMEPIECE TRANSMISSION COUPLING

This application claims priority of European patent application No. EP17179976.0 filed Jul. 6, 2017, which is hereby incorporated by reference herein in its entirety, and this application claims priority of European patent application No. EP17179985.1 filed Jul. 6, 2017, which is hereby incorporated by reference herein in its entirety.

The invention relates to a mechanical linkage element for a mechanical transmission coupling for a timepiece. The invention relates to a mechanical transmission coupling for a timepiece. The invention also relates to a clock mechanism comprising such a transmission coupling. The invention further relates to a watch movement comprising such a transmission coupling or such a mechanism. The invention also relates to a timepiece comprising such a transmission coupling or such a mechanism or such a movement.

Modular watch movements are known in the prior art.

Document EP2085833 discloses a movement having modules which are interchangeable and positionable according to the arrangement of the display units of the wristwatch of which that movement is a part. Different variants of the same movement may thus be obtained by modifying the positioning regarding one or another of the modules with respect to a base plate, which contains a plurality of positioning orifices for each of the modules. The differentiation among the different variants of the movement is thus performed as of the assembly process of the movement, in particular as of the assembly of the modules on the rest of the movement.

Document EP2442191 likewise discloses a movement having modules which are interchangeable and positionable according to the arrangement of the display units of the wristwatch of which that movement is a part. Different variants of the same movement may thus be obtained by modifying the positioning regarding one or another of the modules with respect to an intermediate support fastened to a plate, which contains a plurality of positioning orifices for each of the modules. The differentiation among the different variants of the movement is thus performed as of the assembly process of the movement, in particular as of the assembly of the modules on the rest of the movement.

Such designs may present problems if it is desired to modulate the arrangement of a particular display element of the timepiece once the basic movement has been assembled, since this requires a complete repositioning of at least one module with respect to the plate or the intermediate support. Furthermore, the precision of assembly of the different moving parts involved in such movements may be hard to guarantee, given the large number of intermediate movement-blanks needed to implement each of the modules. Thus, such solutions are not satisfactory.

Document EP2275883 discloses a device for transmission of a movement of homokinetic rotation between a first stem of a watch movement and a second stem of a watch case, whose axes of rotation are substantially parallel. Such a device comprises in particular a linkage element arranged at the interface of the axes of rotation of the two stems, being present in the form of an Oldham coupling. Such an element has two slides respectively arranged on two distinct planes which are substantially perpendicular to the respective axes of rotation of the two stems. Such an embodiment is not feasible for certain applications.

The purpose of the invention is to provide a transmission coupling able to remedy the aforementioned inconveniences and to improve the devices known in the prior art. In particular, the invention proposes a transmission coupling allowing a transmission of precise and homokinetic or substantially homokinetic movement. The invention also proposes a transmission coupling which is compact and particularly well adapted to a watch movement. The invention further proposes a mechanical linkage element for a mechanical transmission coupling allowing a transmission of precise and homokinetic or substantially homokinetic movement. Finally, the invention proposes a mechanical linkage element for a mechanical transmission coupling which is compact and particularly well adapted to a watch movement.

According to a first aspect of the invention, transmission couplings are determined by the following definitions:

1. A transmission coupling (100), especially a timepiece transmission coupling and/or a homokinetic transmission coupling, for the mechanical linkage of at least one first part (2A) of a first shaft at least movable in rotation about a first axis (A2) to at least one second part (3A) of a second shaft at least movable in rotation about a second axis (A3), the first and second axes being parallel or substantially parallel, the transmission coupling comprising:
   the at least one first part (2A) of the first shaft (21),
   the at least one second part (3A) of the second shaft (31), and
   at least a first elastic return system (15, 16; 18; 16*a*'-16*d*'; 111*a*, 111*b*; 221, 222, 223, 224) arranged so as to limit or cancel out the play between the at least one first part (2A) of the first shaft and the at least one second part (3A) of the second shaft,
   the at least one first return system mechanically connecting the at least one first part (2A) of the first shaft and the at least one second part (3A) of the second shaft.
2. The transmission coupling according to definition 1, wherein it comprises a frame (15*a*, 16*a*; 17; 115, 117; 210) on which is secured the at least one first elastic return system.
3. The transmission coupling according to one of definitions 1 and 2, wherein it comprises a second elastic return system (15, 16; 18; 16*a*'-16*d*'; 112*a*, 112*b*; 221, 222, 223, 224) arranged so as to limit or cancel out the play between the at least one first part (2A) of the first shaft and the at least one second part (3A) of the second shaft, the second return system mechanically connecting the at least one first part (2A) of the first shaft and the at least one second part (3A) of the second shaft.
4. The transmission coupling according to one of definitions 1 to 3, wherein the transmission coupling comprises a first sliding element (11) of a first slideway and/or wherein the transmission coupling comprises a second sliding element (12; 12*a*, 12*b*) of a second slideway.
5. The transmission coupling according to one of definitions 1 to 3, wherein the transmission coupling comprises a first sliding element (11) of a first slideway and a second sliding element (12; 12*a*, 12*b*) of a second slideway and wherein the first sliding element and the second sliding element extend, in the direction of the first axis (A2) or the second axis (A3) or in a direction perpendicular to a third axis (D1) of the first slideway and to a fourth axis (D2) of the second slideway, overlapping on axial portions (z1, z2).
6. The transmission coupling according to one of definitions 4 to 5, wherein the first sliding element comprises a groove (11) or several grooves, in particular and one or more rectilinear slideways, and/or wherein the second sliding element comprises a groove (12) or several grooves (12*a*, 12*b*), in particular one or more rectilinear slideways, and/or wherein the first sliding element comprises at least one friction surface (13) and/or wherein the second sliding element comprises at least one friction surface (14).

7. The transmission coupling according to one of definitions 1 to 4 or according to definitions 4 and 6, wherein the at least one first part (2A) of the first shaft and the at least one second part (3A) of the second shaft extend in the direction of the first axis or that of the second axis, superposed on axial portions (Z1, Z2).
8. The transmission coupling according to one of definitions 1 to 7, wherein the at least one first elastic return system comprises one or more first elastic blades (18; 16*a*'-16*d*') and/or the second elastic return system comprises one or more second elastic blades (18; 16*a*'-16*d*').
9. The transmission coupling according to one of definitions 1 to 3, wherein the first elastic return system (111*a*, 111*b*) comprises at least one elastically deformable arm (111*a*, 111*b*) and/or wherein the second elastic return system (112*a*, 112*b*) comprises at least one elastically deformable arm (112*a*, 112*b*).
10. The transmission coupling according to definition 9, wherein the transmission coupling comprises a first receiving element (113) and the at least one first elastic return system is arranged so as to be deformed in order to position the first receiving element along the first axis and/or the transmission coupling comprises a second receiving element (114) and the second elastic return system is arranged so as to be deformed in order to position the second receiving element along the second axis.
11. The transmission coupling according to definition 2, wherein the frame comprises the at least one first part (2A) of the first shaft and at least one cam surface (211, 212, 213, 214), in particular at least one circular opening, designed to cooperate with at least one peg (311, 312, 313, 314) provided on the second shaft, the first elastic return system (221, 222, 223, 224) of the frame comprising at least one elastic blade provided on the at least one cam surface.
12. The transmission coupling according to definition 11, wherein the frame comprises N cam surfaces and/or N elastic blades arranged in a symmetry of rotation of order N, with N being an integer greater than or equal to 2, and/or wherein the cam surfaces each comprise a friction surface.
13. The transmission coupling according to one of definitions 1 to 12, wherein the at least one first part (2A) of the first shaft comprises a second sliding element (22) of the first slideway, in particular a second projecting element of rectangular or substantially rectangular shape or in the form of pegs, and/or wherein the at least one second part (3A) of the second shaft comprises a second sliding element (32; 32*a*, 32*b*) of the second slideway, in particular a second projecting element of rectangular or substantially rectangular shape or in the form of pegs.

According to the first aspect of the invention, a linkage element is determined by the following definition:

14. A mechanical linkage element (10; 110; 210) for a transmission coupling (100), the mechanical linkage element being designed to transmit a movement of rotation, being particularly designed to transmit a movement of rotation in homokinetic manner, from a first shaft (21) to a second shaft (31), the second shaft being off-center with respect to the first shaft, the linkage element comprising:
   a first conformation (11; 113; 220) to receive the first shaft (21);
   a second conformation (12; 114; 211, 212, 213, 214) to receive the second shaft (31);
   at least a first elastic return system (15, 16; 18; 16*a*'-16*d*'; 111*a*, 111*b*; 221, 222, 223, 224) arranged so as to cooperate with the first or the second receiving conformation.

According to the first aspect of the invention, a transmission coupling is determined by the following definition:

15. A transmission coupling comprising:
   a linkage element according to definition 14,
   at least one first part (2A) of a first shaft (21), and
   at least one second part (3A) of a second shaft (31).

According to the first aspect of the invention, a clock mechanism is determined by the following definition:

16. A clock mechanism (200) comprising:
   a transmission coupling according to one of definitions 1 to 13 or 15, a geartrain (110) and a display element (6), the first shaft, especially the at least one first part (2A) of the first shaft, being in engagement with the geartrain and the second shaft, especially the at least one second part (3A) of the second shaft, being in engagement with the display element, or
   a linkage element according to definition 14.

According to the first aspect of the invention, a timepiece movement is determined by the following definition:

17. A watch movement (300) comprising a transmission coupling according to one of definitions 1 to 13 or 15 or a mechanism according to definition 16 or a linkage element according to definition 14.

According to the first aspect of the invention, a timepiece is determined by the following definition:

18. A timepiece (400), especially a wristwatch, comprising a movement according to definition 17 or a mechanism according to definition 16 or a transmission coupling according to one of definitions 1 to 13 or 15 or a linkage element according to definition 14.

According to a second aspect of the invention, mechanical linkage elements are determined by the following definitions:

19. A mechanical linkage element (10) for a transmission coupling (100), the mechanical linkage element being designed to mechanically link a first shaft (21) to a second shaft (31), the mechanical linkage element comprising a first sliding element (11) of a first slideway, especially along a first axis (D1), and a second sliding element (12) of a second slideway, especially along a second axis (D2), the first and second sliding elements being designed to cooperate with the at least one first part (2A) of the first shaft and the at least one second part (3A) of the second shaft, the first sliding element and the second sliding element extending, along a third axis (D3) perpendicular or substantially perpendicular to the first axis and to the second axis or along a third axis (D3) parallel or substantially parallel to the axes (A2), (A3) of the first and second shafts, overlapping or superposed on axial portions (z1, z2).
20. The mechanical linkage element (10) according to definition 19, wherein the first sliding element comprises a groove (11) or several grooves, and/or wherein the second sliding element comprises a groove (12) or several grooves (12*a*, 12*b*), and/or wherein the first sliding element comprises at least one friction surface (13) and/or wherein the second sliding element comprises at least one friction surface (14).
21. The mechanical linkage element (10) according to one of definitions 19 and 20, wherein the mechanical linkage element (10) comprises at least a first elastic return system (15, 16; 18; 16*a*'-16*d*'; 111*a*, 111*b*; 221, 222, 223, 224) arranged so as to limit or cancel out the play between the at least one first part (2A) of the first shaft and the at least one second part (3A) of the second shaft, the at least one first return system mechanically connecting the at least one first part (2A) of the first shaft and the at least one second part (3A) of the second shaft.

22. The mechanical linkage element (10) according to definition 21, wherein the mechanical linkage element (10) comprises a second elastic return system (15, 16; 18; 16*a*'-16*d*'; 112*a*, 112*b*; 221, 222, 223, 224) arranged so as to limit or cancel out the play between the at least one first part (2A) of the first shaft and the at least one second part (3A) of the second shaft, the second return system mechanically connecting the at least one first part (2A) of the first shaft and the at least one second part (3A) of the second shaft.

23. The mechanical linkage element (10) according to definition 21 or 22, wherein it comprises a frame (15*a*, 16*a*; 17; 115, 117; 210) on which is secured the at least one first elastic return system and/or the second elastic return system.

24. The mechanical linkage element (10) according to one of definitions 21 to 23, wherein the first elastic return system comprises one or more first elastic blades (18; 16*a*'-16*d*') and/or the second elastic return system comprises one or more second elastic blades (18; 16*a*'-16*d*').

25. The mechanical linkage element (10) according to one of definitions 21 to 24, wherein the first elastic return system comprises at least a first abutment (19) to limit the deformation of the first elastic return system and/or the second elastic return system comprises at least a second abutment (19) to limit the deformation of the second elastic return system.

According to the second aspect of the invention, transmission couplings are determined by the following definitions:

26. A transmission coupling (100), especially a timepiece transmission coupling and/or a homokinetic transmission coupling, for the mechanical linkage of at least one first part (2A) of a first shaft at least movable in rotation about a fourth axis (A2) to at least one second part (3A) of a second shaft at least movable in rotation about a fifth axis (A3), the fourth and fifth axes being parallel or substantially parallel, the coupling comprising:
   the at least one first part (2A) of the first shaft (21),
   the at least one second part (3A) of the second shaft (31), and
   a linkage element (10) according to one of definitions 19 to 25.

27. The transmission coupling according to definition 26, wherein the transmission coupling, especially the at least one first part (2A) of the first shaft, comprises at least a third elastic return system (21*a*, 21*b*) arranged so as to limit or cancel out the play between the at least one first part (2A) of the first shaft and the linkage element, the at least one third return system mechanically connecting the at least one first part (2A) of the first shaft and the linkage element and/or wherein the transmission coupling, especially the at least one second part (3A) of the second shaft, comprises a fourth elastic return system (32*a*, 32*b*) arranged so as to limit or cancel out the play between the at least one second part (3A) of the second shaft and the linkage element, the at least one first return system mechanically connecting the at least one second part (3A) of the second shaft and the linkage element.

28. The transmission coupling according to one of definitions 26 and 27, wherein the at least one first part (2A) of the first shaft comprises a second sliding element (22; 22*a*, 22*b*) of the first slideway or of the second slideway, in particular a second projecting element of rectangular or substantially rectangular shape or in the form of pegs, and/or wherein the at least one second part (3A) of the second shaft comprises a second sliding element (32; 32*a*, 32*b*) of the first slideway or of the second slideway, in particular a second projecting element of rectangular or substantially rectangular shape or in the form of pegs.

According to the second aspect of the invention, clock mechanisms are determined by the following definitions:

29. A clock mechanism (200) comprising:
   a transmission coupling according to one of definitions 26 to 28, a train of a transmission chain (1100) and a display element (6), the first shaft, especially the at least one first part (2A) of the first shaft, being in engagement with the train of a transmission chain and the second shaft, especially the at least one second part (3A) of the second shaft, being in engagement with the display element, or
   a linkage element according to one of definitions 19 to 25.

30. The clock mechanism (200) according to definition 29, wherein it comprises a first moving part (2) including a first shaft (21), a second moving part (3) including a second shaft (31) and at least one friction element (301, 302), in particular at least one friction foil, arranged so as to act on the first moving part (1) and/or on the first moving part (2), in particular arranged so as to act on the first shaft and/or on the second shaft.

According to the second aspect of the invention, a watch movement is determined by the following definition:

31. A watch movement (300) comprising a transmission coupling according to one of definitions 26 to 28 or a mechanism according to one of definitions 29 and 30.

According to the second aspect of the invention, a timepiece is determined by the following definition:

32. A timepiece (400), especially a wristwatch, comprising a movement according to definition 31 or a mechanism according to one of definitions 29 and 30 or a transmission coupling according to one of definitions 26 to 28 or a linkage element according to one of definitions 19 to 25.

According to a third aspect of the invention, mechanical linkage elements are determined by the following definitions:

33. A mechanical linkage element (10; 110; 210) for a transmission coupling (100), the mechanical linkage element being designed to transmit a movement of rotation, being particularly designed to transmit a movement of rotation in homokinetic manner, from a first shaft (21) to a second shaft (31), the second shaft being off-center with respect to the first shaft, the linkage element comprising:
   a first conformation (11; 113; 220) to receive the first shaft (21);
   a second conformation (12; 114; 211, 212, 213, 214) to receive the second shaft (31);
   at least a first elastic return system (15, 16; 18; 16*a*'-16*d*'; 111*a*, 111*b*; 221, 222, 223, 224) arranged so as to cooperate with the first or the second receiving conformation, in particular arranged so as to limit or cancel out the play between the first receiving conformation and the first shaft.

34. The element according to definition 33, wherein the first elastic return system is designed to act on:

at least a first surface of the first conformation, the at least one first surface being designed to come into contact with the first shaft, or at least a second surface of the second conformation, the at least one second surface being designed to come into contact with the second shaft.

35. The element according to definition 33 or 34, wherein the at least one first elastic return system (15, 16; 18; 16*a*'-16*d*'; 111*a*, 111*b*; 221, 222, 223, 224) is arranged in the area of the first or the second receiving conformation.

36. The element according to one of definitions 33 to 35, wherein the mechanical linkage element comprises a second elastic return system (15, 16; 18; 16*a*'-16*d*'; 111*a*, 111*b*; 221, 222, 223, 224) arranged so as to cooperate with the first or the second receiving conformation in particular arranged so as to limit or cancel out the play between the second receiving conformation and the second shaft.

37. The element according to definition 36, wherein the second elastic return system is designed to act on:

at least a third surface of the first conformation, the at least one third surface being designed to come into contact with the first shaft, or at least a fourth surface of the second conformation, the at least one fourth surface being designed to come into contact with the second shaft.

38. The element according to definition 36 or 37, wherein the second elastic return system (15, 16; 18; 16*a*'-16*d*'; 111*a*, 111*b*; 221, 222, 223, 224) is arranged in the area of the first or the second receiving conformation.

39. The element according to one of definitions 33 to 38, wherein the first conformation is a first sliding element, especially one or more grooves or one or more projecting elements and/or wherein the second conformation is a second sliding element, especially one or more grooves or one or more projecting elements.

According to the third aspect of the invention, a transmission coupling is determined by the following definition:

40. A transmission coupling comprising:

a linkage element according to one of definitions 33 to 39, at least one first part (2A) of a first shaft (21), and at least one second part (3A) of a second shaft (31).

According to the third aspect of the invention, a clock mechanism is determined by the following definition:

41. A clock mechanism (200) comprising:

a transmission coupling according to definition 40, a geartrain (110) and a display element (6), the first shaft, especially the at least one first part (2A) of the first shaft, being in engagement with the geartrain and the second shaft, especially the at least one second part (3A) of the second shaft, being in engagement with the display element, or an element according to one of definitions 33 to 39.

According to the third aspect of the invention, a watch movement is determined by the following definition:

42. A watch movement (300) comprising a transmission coupling according to definition 40 or a mechanism according to definition 41 or an element according to one of definitions 33 to 39.

According to the third aspect of the invention, a timepiece is determined by the following definition:

43. A timepiece (400), especially a wristwatch, comprising a movement according to definition 42 or a mechanism according to definition 41 or a transmission coupling according to definition 40 or an element according to one of definitions 33 to 39.

Except for technical incompatibility or logical incompatibility, all the characteristics of the different aspects may be combined with each other.

The attached figures represent, as examples, four embodiments of a timepiece according to the invention.

Figure 1:
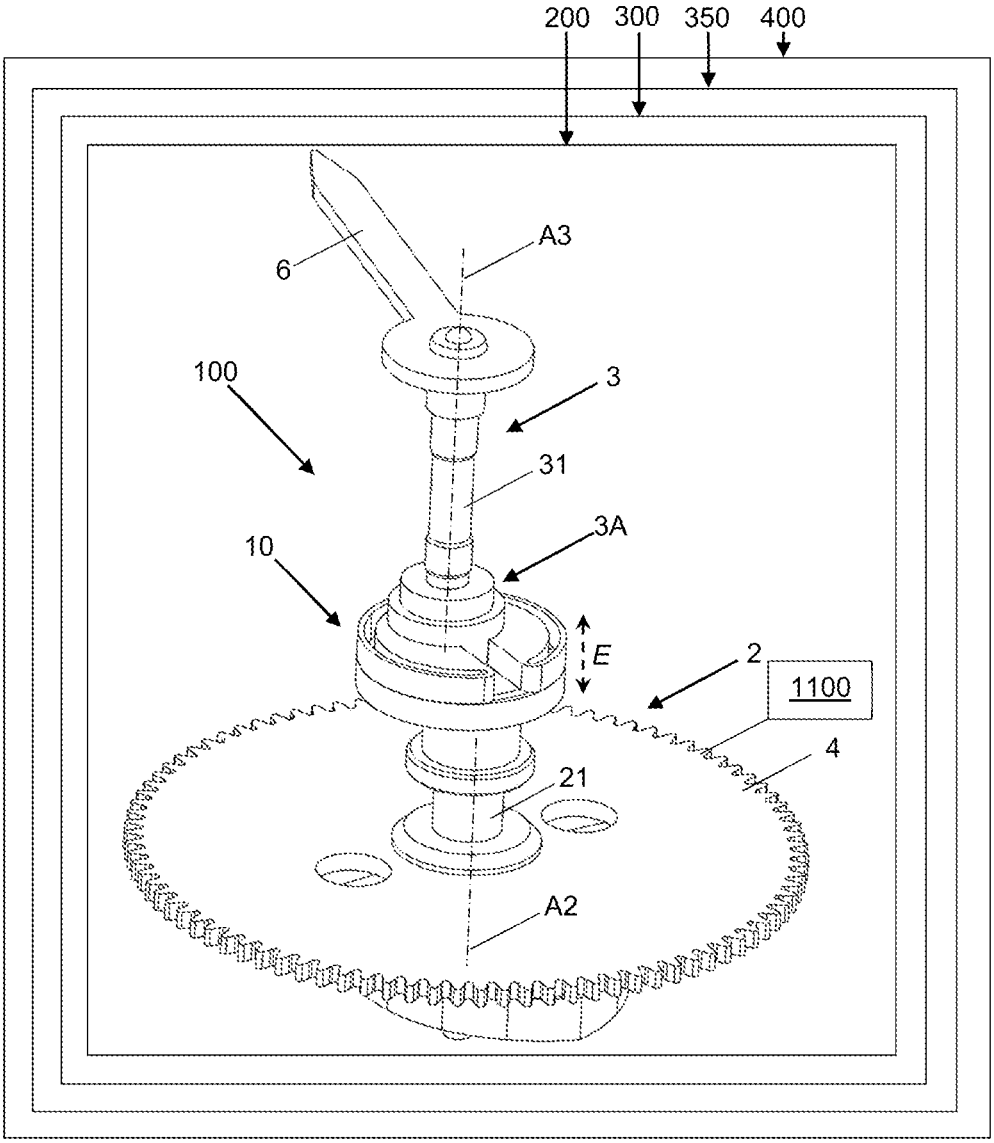
FIGS. 1 to 11 illustrate a first embodiment of a timepiece having a first embodiment of the transmission coupling.
Figure 2:
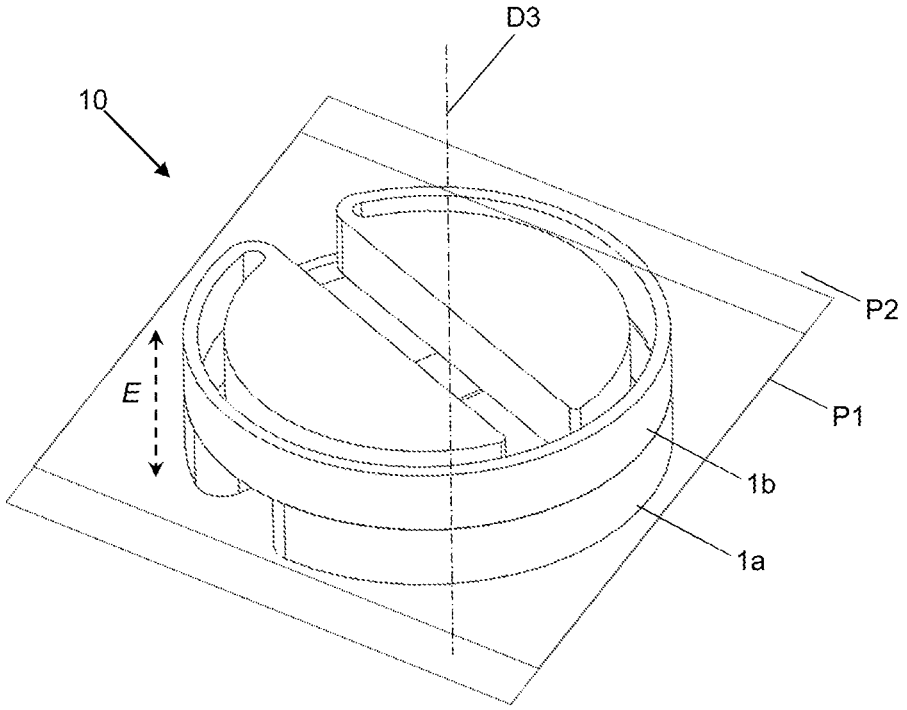
Figure 3:
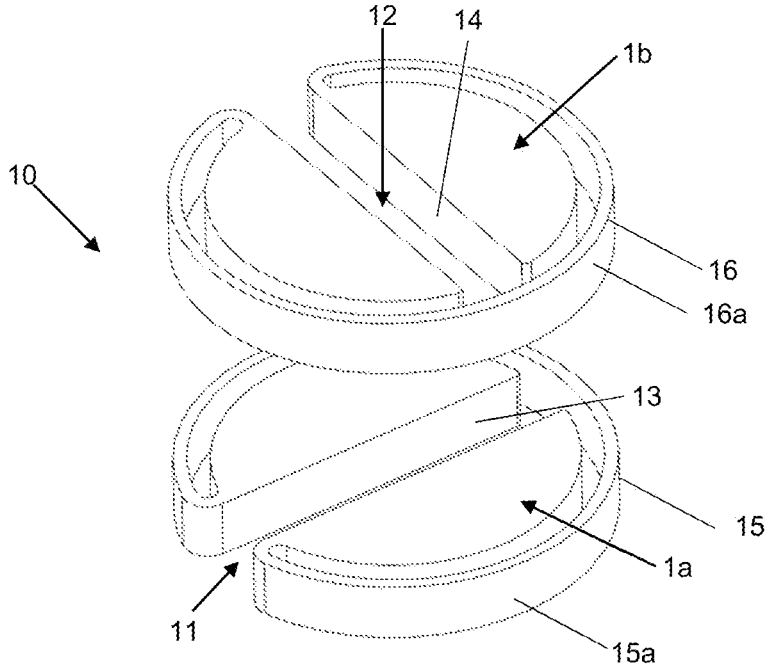
Figure 4:
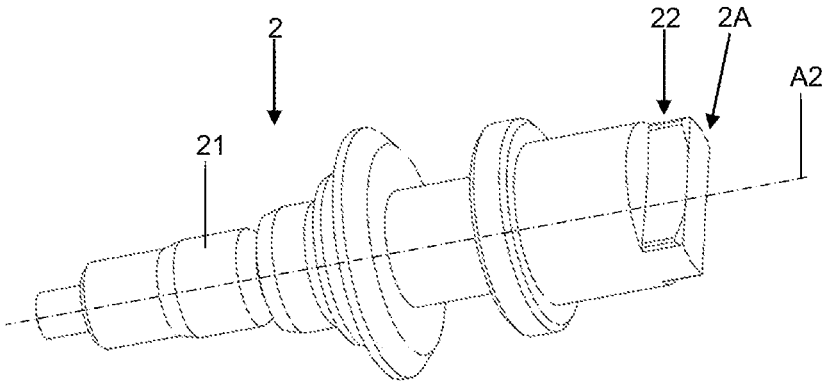
Figure 5:
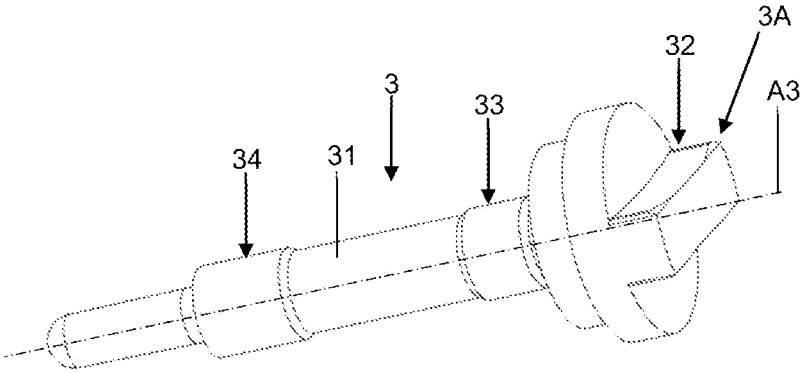
Figure 6:
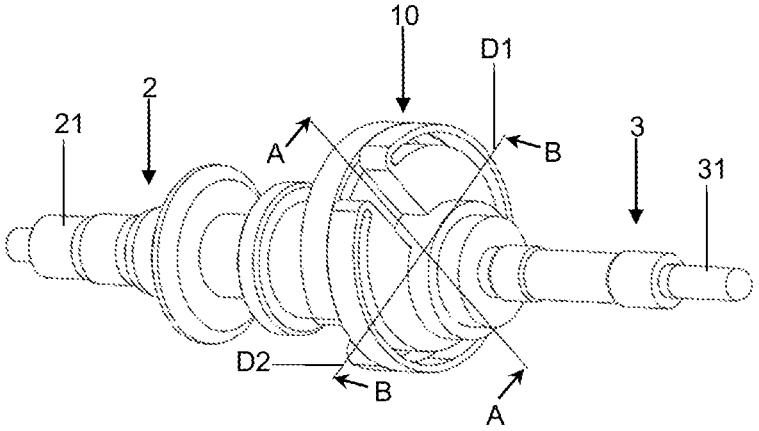

A first embodiment of a timepiece 400 is described below with reference to FIGS. 1 to 11. The timepiece is for example a watch, in particular a wristwatch. The timepiece comprises a watch case 350 and a watch movement 300 mounted in the watch case. The movement may be of the mechanical type. In particular, it may be of the automatic type. Alternatively, the movement may be of the electronic type.

The movement comprises a mechanism for transmission of movement 200 or the watch case comprises a mechanism for transmission of movement or the timepiece comprises a mechanism for transmission of movement at the interface of the watch case and the movement.

The mechanism for transmission of movement comprises, for example, besides a transmission coupling 100, a train of a chain 1100 of transmission and a display element 6. Thus, the display element may for example display or indicate information about the time or derived from the time. The display element may comprise a pointer 6, especially a pointer indicating time information or time-based information in cooperation with a limb and/or indexes arranged on a dial. The train of a chain of transmission may be a geartrain providing the linkage between a powering element such as a barrel and a regulating element such as an oscillator of spring and balance type. Alternatively, the chain 1100 of transmission may be present, for example, in the form of a chronograph counting chain. The mechanism may further include a timepiece module, such as a chronograph module, between the geartrain and the transmission coupling.

Figure 10:
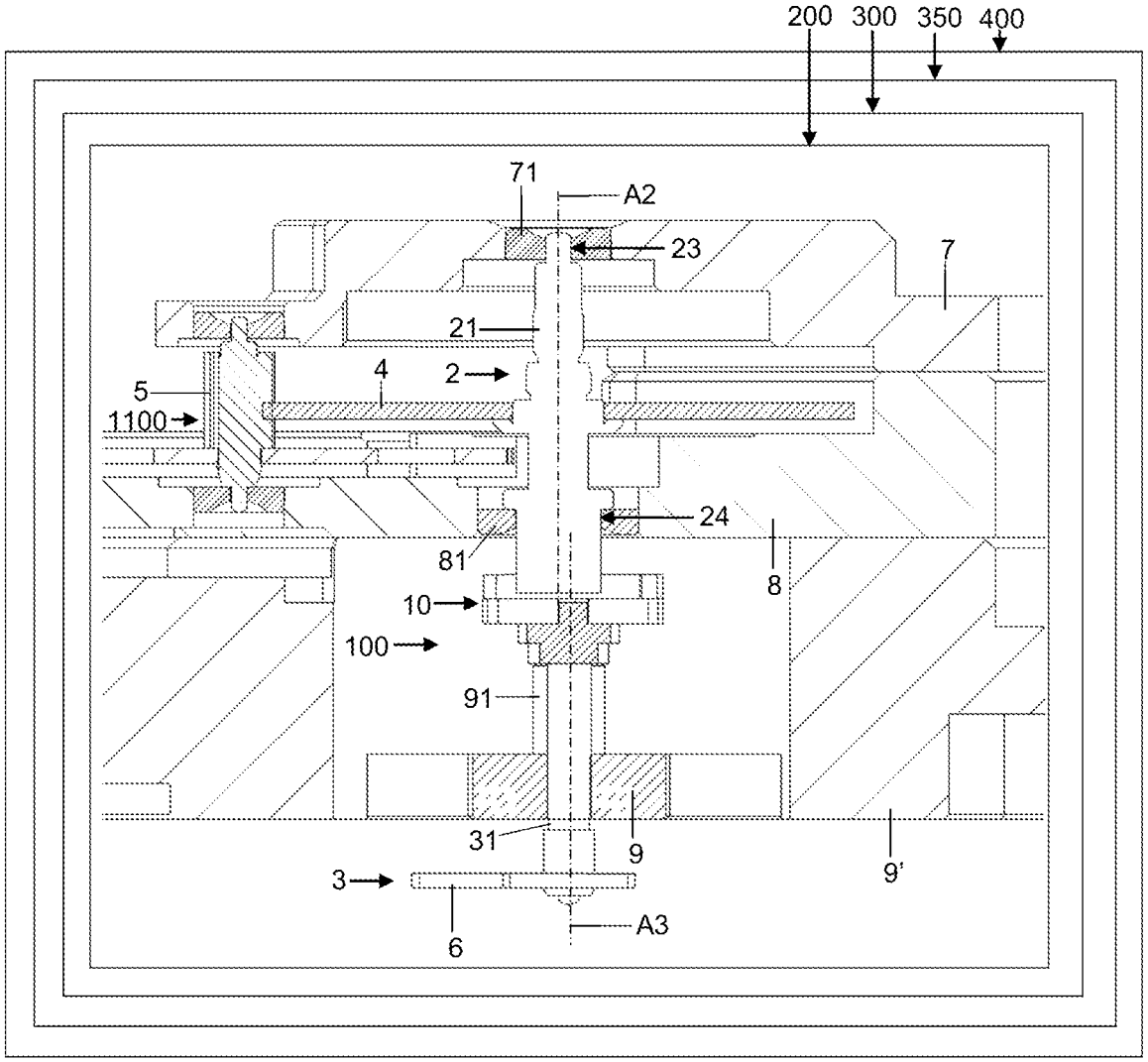
Figure 11:
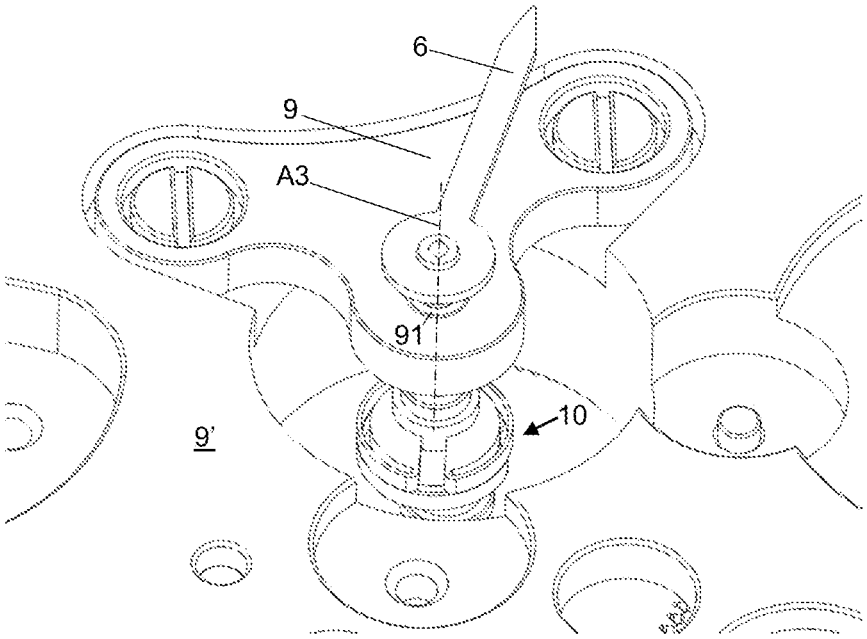
Figure 12:
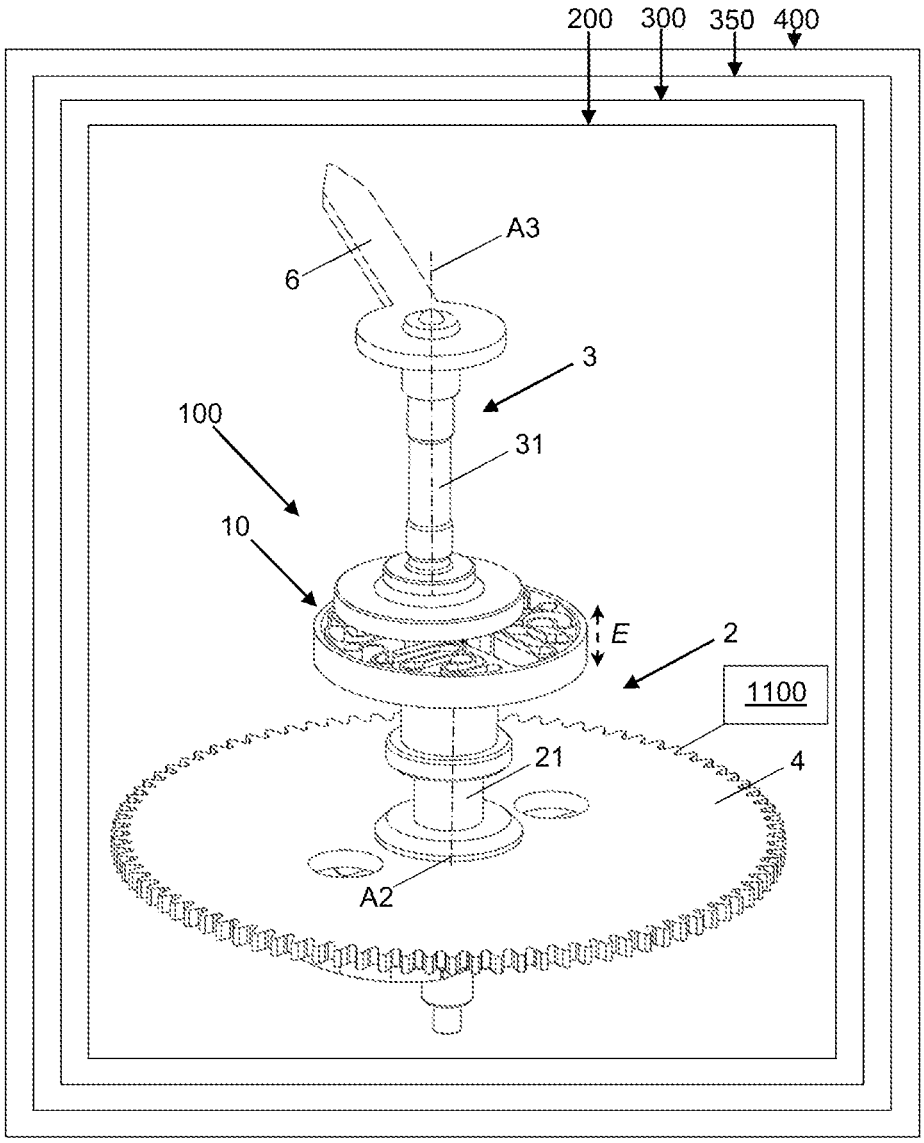
FIGS. 12 to 17 illustrate a second embodiment of a timepiece having a first variant or a second variant of a second embodiment of the transmission coupling.

As represented in FIGS. 1, 10 and 11, the watch movement may be modular. The coupling 100 here allows the connecting of a chronograph moving part 2 to a display moving part 3 for information provided by said chronograph moving part 2. The moving part 2 is an integral part of a chronograph counting chain 1100. The latter comprises a wheel 4 mounted on a shaft 21 and kinematically linked to a pinion 5 of the chronograph counting chain 1100, as represented in FIG. 10. The moving part 3 comprises the display element 6 which is mounted on a shaft 31. The shaft 21 has pivoting elements 23, 24, in particular cylindrical seats 23, 24, able to cooperate with bearings 71, 81, in particular jewels 71, 81, mounted respectively on movement-blanks 7, 8 of the movement so as to guide the shaft 21 in rotation about its axis A2. The shaft 31 likewise comprises pivoting elements 33, 34, in particular cylindrical seats 33, 34, able to cooperate with a bearing 91, in particular a tube 91, mounted on a movement-blank 9 of the movement so as to guide the shaft 31 in rotation about its axis A3. Preferably, the movement-blank 9 can be mounted on a plate 9' of the movement 200 as represented in FIG. 11.

Figure 9:
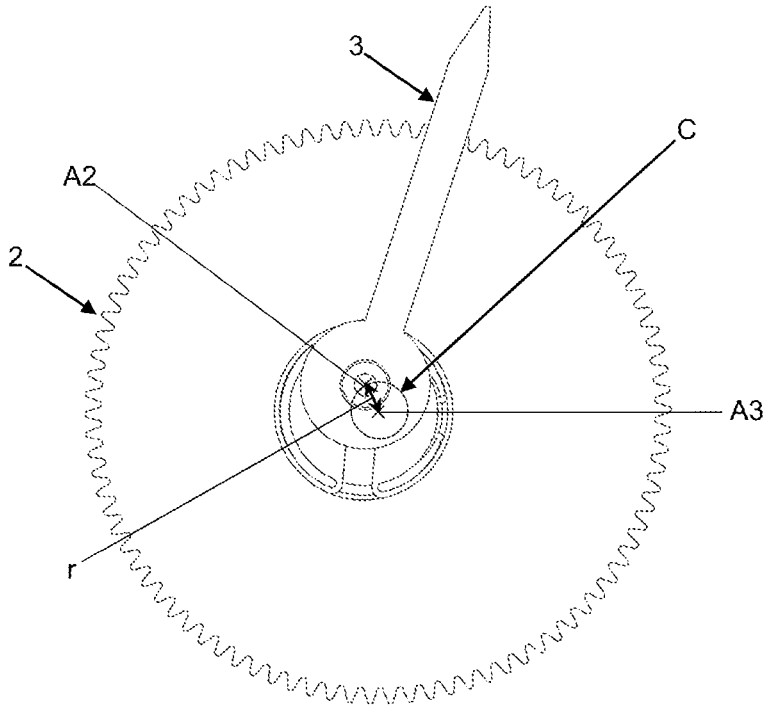

Depending on the location of the axis A3 with regard to the axis A2, it is sufficient for the watchmaker to select an adequate movement-blank 9 having a bearing 91 whose axis coincides with the desired axis A3. Alternatively, the movement-blank 9 may comprise a plurality of bearings (not shown) so as to receive the shaft 31 with a desired spacing r between the axis A2 and the axis A3 and/or with an angular position of the axis A3 relative to the axis A2 as represented in FIG. 9, all of the angular positions of the spacing r forming a circle C.

The transmission coupling 100 is preferably of homokinetic type. The coupling is arranged so as to mechanically link at least a first part 2A of the first shaft which is at least movable in rotation about a first axis A2 to at least one second part 3A of the second shaft which is at least movable in rotation about a second axis A3. The first and second axes are parallel or substantially parallel. In this embodiment, the at least one first part 2A of the first shaft is made as an integral unit with the rest of the first shaft. The at least one first part 2A of the first shaft and the remainder of the first shaft thus form a monobloc assembly and thus together form the first shaft. In this embodiment, the at least one second part 3A of the second shaft is made as an integral unit with the rest of the second shaft. The at least one second part 3A of the second shaft and the remainder of the second shaft thus form a monobloc assembly and thus together form the second shaft.

The shafts 21, 31 here are movable in rotation respectively about the axes A2, A3.

The transmission coupling comprises, besides the at least one first part 2A of the first shaft and the at least one second part 3A of the second shaft, at least a first elastic return system 15 arranged so as to limit or cancel out the play between the at least one first part 2A of the first shaft and the at least one second part 3A of the second shaft. The at least one first return system, possibly associated with a second return system 16, mechanically connects the at least one first part 2A of the first shaft and the at least one second part 3A of the second shaft.

The transmission coupling comprises at least one linkage element 10, 110, 210 arranged at the interface of the respective shafts 21, 31 of two moving parts 2, 3, particularly at the interface between the first part 2A of the first shaft and the second part 3A of the second shaft.

Advantageously, the transmission coupling comprises a frame on which is secured the at least one first elastic return system 15. As a variant illustrated in FIG. 3, the frame 15*a*, 16*a* is partly formed by a portion of the at least one first elastic return system 15, particularly by a portion of the first elastic return system 15 and by a portion of the second elastic return system 16.

Preferably, the coupling comprises a second elastic return system 16 arranged so as to limit or cancel out the play between the at least one first part 2A of the first shaft and the at least one second part 3A of the second shaft, the at least one first return system mechanically connecting the at least one first part 2A of the first shaft and the at least one second part 3A of the second shaft.

Preferably, the transmission coupling comprises a first sliding element 11 of a first slideway.

Preferably, the transmission coupling comprises a second sliding element 12; 12*a*, 12*b* of a second slideway.

Preferably, the first sliding element comprises a groove or several grooves and/or the second sliding element comprises a groove or several grooves and/or the first sliding element comprises at least one friction surface 13 and/or the second sliding element comprises at least one friction surface 14. These friction surfaces are advantageously the flanks of the sliding elements.

Preferably, the at least one first elastic return system comprises one or more first elastic blades and/or the second elastic return system comprises one or more second elastic blades.

The first shaft and the second shaft extend, in the direction of the first axis or the second axis, on axial portions Z1 and Z2 which are each aligned with the axes A2 and A3, respectively, yet which do not overlap. In fact, as represented in FIG. 7, the first shaft extends for a portion Z1 and the second shaft extends for a portion Z2.

Figure 7:
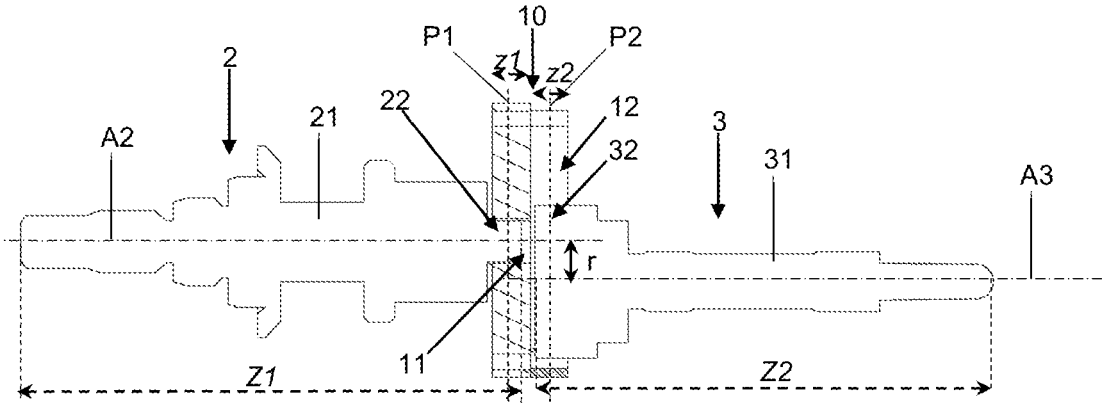
Figure 8:
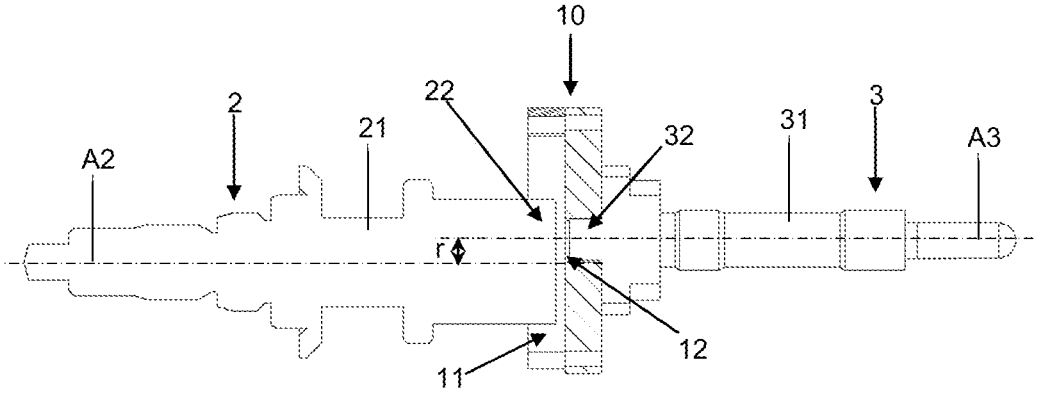

The axial portions z1, z2 along which the first sliding element and the second sliding element extend are superposed in the direction of the first axis or the second axis, that is, the axial portions are each aligned respectively with the axes A2 and A3, yet they do not overlap, as represented in FIG. 7. The first sliding element and the second sliding element are disposed in distinct planes P1, P2.

The first shaft comprises a second sliding element 22 of the first slideway, in particular a second projecting element of substantially rectangular shape. Alternatively, the second element could comprise several pegs. The second shaft comprises a second sliding element 32 of the second slideway, in particular a second projecting element of substantially rectangular shape. Alternatively, the second element could comprise several pegs.

Thus, in the first embodiment, the linking element 10 is provided with two sliding elements 11, 12 or two slides 11, 12 similar to those of an Oldham coupling. These slides 11, 12 are, for example, hollow and designed to cooperate respectively with sliding elements or slide elements 22, 32 of the shafts 21, 31 of the moving parts 2, 3. These elements 22, 32 are projecting, for example. These elements 22, 32 each have a geometry which is substantially complementary to that of the slides 11, 12. For example, these elements 22, 32 may have a conformation with a substantially rectangular cross section in a plane perpendicular to the axes A2, A3, this conformation of rectangular cross section prolonging the shaft in the direction of its axis. For example, these elements 22, 32 have parallelepiped shapes with one flank of larger dimension extending perpendicular to the axes A2, A3 of the shafts. The largest side of the parallelepiped conformation may correspond, or substantially correspond, to the diameter of a portion of the respective parts 2A, 3A of the first and second shafts.

In the first embodiment, the slides 11, 12 are arranged in two distinct planes P1, P2 which are substantially parallel, as represented in FIG. 7. The planes are, for example, the median planes of the slides.

Advantageously, the element 10 likewise comprises at least one friction element 13, 14 designed to connect with less play, especially less angular play, the moving parts 2 and 3. The friction elements are parts of the slides 11, 12, especially contact faces of the slides. The friction elements are mounted in contact against the slide elements 22, 32 by the first and second elastic return systems. To do so, the at least one friction element 13, 14 cooperates with an elastic return element 15, 16 designed to return the at least one element 13, 14 to a state of cooperation with the one or the other of the slide elements 22, 32 of the shafts 21, 31, particularly in contact with the one or the other of the slide elements 22, 32 of the shafts 21, 31. Thus, the element 10 can connect kinematically, in particular homokinetically or substantially homokinetically, two moving parts 2, 3 whose axes A2, A3 of rotation are substantially parallel and close together, while minimizing as much as possible the angular play at the interface of the shafts 21, 31.

In the first embodiment, the element 10 comprises two friction elements 13, 14 which are respectively coincident with the slides 11, 12. Each slide 11, 12 or friction element 13, 14 is elastically returned by an elastic element 15, 16 which is present in the form of an elastic blade 15, 16 defining the perimeter of portions 1*a*, 1*b* of the element 10. The thickness of the element is denoted E in the various figures.

The element 10 for example is made up of two portions 1*a*, 1*b* disposed respectively in the two parallel planes P1, P2. The first portion 1*a* comprises the first slide 11, the first friction element 13, as well as the elastic blade 15. The second portion 1*b* comprises the second slide 12, the second friction element 14, as well as the elastic blade 16. Preferably, each portion 1*a*, 1*b* is present in the form of a monobloc subassembly or made as an integral unit. The portions 1*a*, 1*b* may be joined by welding, especially by laser welding, in particular at a predefined zone of the portions 1*a*, 1*b* so as to sustain the elastic nature of the elements 15, 16.

Alternatively, the element 10 may be present in the form of a monobloc or integrated component.

The subassemblies 1*a*, 1*b* or the element 10 can be made of silicon and/or coated silicon, especially coated with silicon dioxide or silicon nitride, or with nickel or a nickel-phosphorus alloy. Of course, the subassemblies 1*a*, 1*b* or the element 10 may alternatively be made of a totally different material, especially any other elastic material, such as a metallic glass or even a polymer.

The subassemblies 1*a*, 1*b* can be made of the same material, or not. The subassemblies or the element can be fabricated preferably by electroforming or by etching. Alternatively, the subassemblies 1*a*, 1*b* or the element could be machined by electro-erosion or by laser.

Preferably, the slides 11, 12 of the element 10 are arranged perpendicular to each other so as to allow a transmission of movements of rotation between the shafts 21 and 31, as is permitted by the Oldham principle. The slides 11, 12 are furthermore preferably arranged perpendicular to the first and second axes. The functioning of this embodiment is based on the fact that the driving shaft, for example the shaft 21, entrains in rotation the linkage element by action of the projecting element 22 on the flanks of the groove 11 and the linkage element entrains in rotation the driven shaft by action of the flanks of the groove 12 on the projecting element 32, the projecting elements being displaced in the grooves 11 and 12.

The extent of the slides makes it possible to define the maximum spacing between the axes A2, A3. The location of the bearing 91 makes it possible to define the position of the axis A3 with respect to the axis A2 for a given range of spacings r. Preferably, the linkage element 10 makes it possible to define spacings r between 0 and 1 mm, or between 0 and 0.6 mm.

In general, such a transmission coupling may be advantageously implemented at the interface of the shafts 21 and 31 when it is not possible to accommodate toothed moving parts between these two elements.

Advantageously, the transmission coupling makes it possible to transmit the movements of rotation of the shaft 21 to the shaft 31 smoothly. In particular, the movement of rotation of the wheel 4 is transmitted to the pointer 6 smoothly, which means an absence of trembling of the pointer 6. Advantageously, the transmission coupling, in particular the friction elements 13, 14 of the element 10, can replace a friction foil while ensuring its function. Preferably, the friction torque generated is of the order of 0.1 to 5 pNm, or of the order of 1 to 5 pNm. Thus, the very same element 10 of the coupling serves as a transmission element and a regulator of the transmission.

In one variant embodiment (not shown) of the first embodiment, the at least one first part 2A of the first shaft comprises a third elastic return system arranged so as to limit or cancel out the play between the first sliding element in the first slideway and/or the at least one second part 3A of the second shaft comprises a fourth elastic return system arranged so as to limit or cancel out the play of the second sliding element in the second slideway. The third return system may replace the first return system. Alternatively, the third return system may supplement the first return system so as to limit or cancel out together the play in the first slideway. The fourth return system may replace the second return system. Alternatively, the fourth return system may supplement the second return system so as to limit or cancel out together the play in the second slideway.

The third elastic return system may comprise one or more third elastic blades and/or the fourth elastic return system may comprise one or more fourth elastic blades.

The third elastic return system may comprise at least a third abutment limiting the deformation of the third elastic return system and/or the fourth elastic return system may comprise at least a fourth abutment limiting the deformation of the fourth elastic return system.

In other words, the transmission coupling 100 according to the first embodiment is an Oldham coupling having a first and a second slideway or slide and comprising a first elastic system for limiting, or canceling out, the play in the first slideway and a second elastic system for limiting, or canceling out, the play in the second slideway.

A second embodiment of a timepiece 400 is described below with reference to FIGS. 12 to 22.

This second embodiment differs from the first embodiment in the area of the transmission coupling.

As in the first embodiment, the transmission coupling 100 is preferably of homokinetic type. The coupling is arranged so as to mechanically link at least a first part 2A of the first shaft 21 which is at least movable in rotation about a first axis A2 to at least one second part 3A of the second shaft 31 which is at least movable in rotation about a second axis A3. The first and second axes are parallel or substantially parallel. The at least one first part 2A of the first shaft is made of the same material as the rest of the first shaft. The at least one first part 2A of the first shaft and the remainder of the first shaft thus form a monobloc assembly and thus together form the first shaft. The at least one second part 3A is made of the same material as the rest of the second shaft. The at least one second part 3A and the remainder of the second shaft thus form a monobloc assembly and thus together form the second shaft.

The coupling comprises the at least one first part 2A of the first shaft and the at least one second part 3A of the second shaft.

The transmission coupling 100 likewise comprises a linkage element 10.

The shafts 21, 31 are movable in rotation respectively about the axes A2, A3.

The mechanical linkage element is designed to mechanically link the first shaft 21 to a second shaft 31. The mechanical linkage element comprises a first sliding element 11 of a first slideway, extending in particular along a first axis D1, and a second sliding element 12 of a second slideway, extending in particular along a second axis D2.

The first and second sliding elements are designed to cooperate with the at least one first part 2A of the first shaft and the at least one second part 3A of the second shaft.

Figure 17:
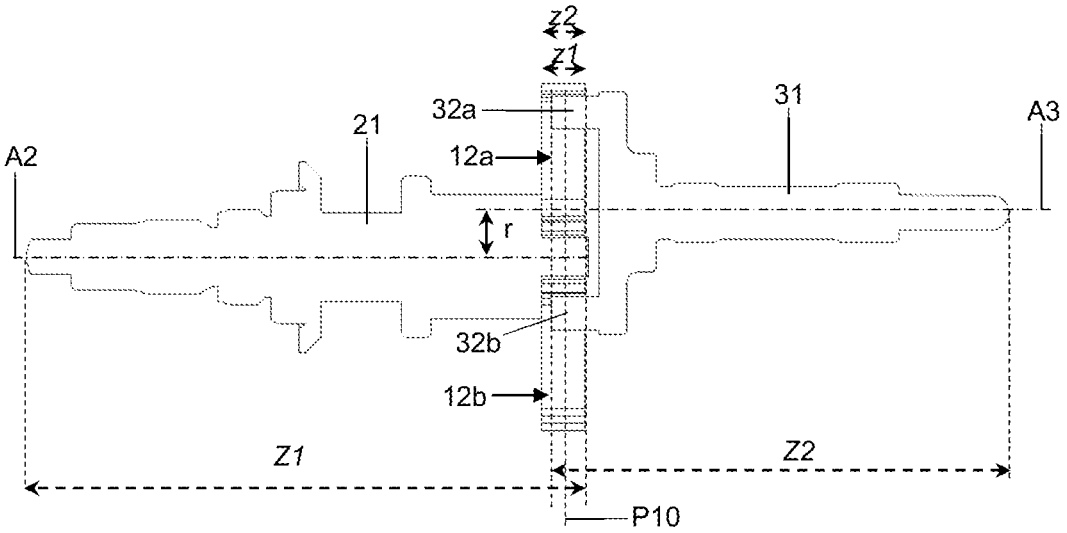
Figure 18:
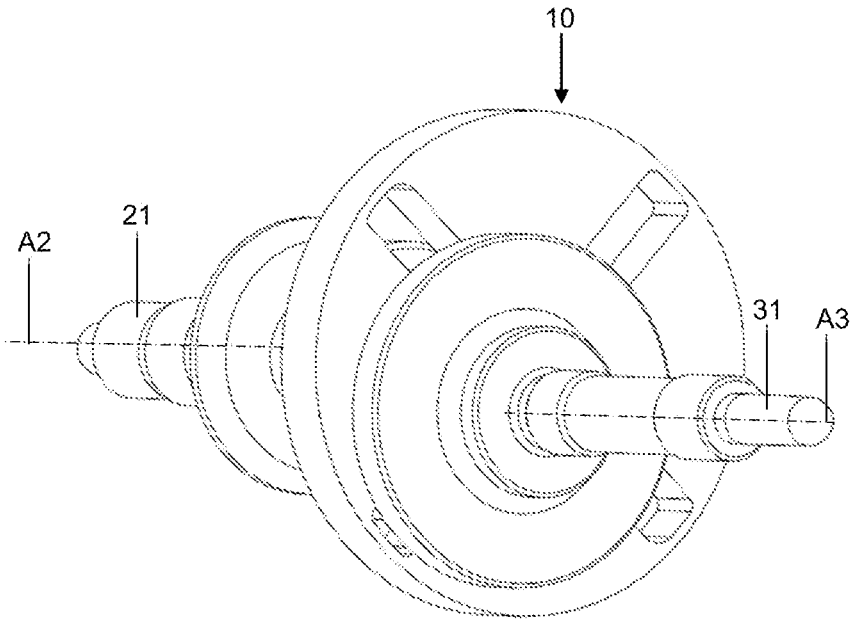
FIGS. 18 to 20 illustrate a third variant of the second embodiment of the transmission coupling.

However, in the second embodiment, the first sliding element and the second sliding element extend along a third axis D3:

perpendicular or substantially perpendicular to the first axis D1 and to the second axis D2, and/or parallel or substantially parallel to the axes A2, A3 of the first and second shafts, on axial portions z1, z2 overlapping in whole or in part, as represented in FIG. 17.

In the embodiment shown, the axial portions along which the first sliding element and the second sliding element extend in the direction of the first axis or the second axis are totally overlapping, that is, they are totally covering each other or they are coincident. The first sliding element and the second sliding element are thus disposed in the same median plane P10.

Alternatively, the axial portions along which the first sliding element and the second sliding element extend in the direction of the first axis or the second axis might be partly overlapping. This would be the case, for example, for an element 10 in which the first sliding element and the second sliding element are realized by non-opening grooves made from two opposite faces of the element, the total of the depths of the grooves being greater than the thickness E of the element. The first sliding element and the second sliding element would then be disposed in substantially coincident median planes.

Thus, in this embodiment, the linkage element 10 is provided with slides 11, 12 arranged in the same plane P10 which substantially coincides with the median plane of the element 10. This second embodiment thus has the advantage of being particularly compact and not very bulky. Such an element also has the advantage of being particularly easy to manufacture, especially when said element is manufactured by electroforming or by etching.

In this second embodiment, the first sliding element has one groove 11 or several grooves. The second sliding element has several grooves 12*a*, 12*b*. The grooves 12*a* and 12*b* are advantageously aligned.

Advantageously, the first sliding element comprises at least one friction surface 13, particularly a friction surface 13 formed by one face of the groove 11. Advantageously, the second sliding element comprises at least two friction surfaces 14*a* and 14*b*, formed by faces of the grooves 12*a* and 12*b*.

As in the first embodiment, the transmission coupling advantageously comprises a frame 17 on which is secured the at least one first elastic return system and/or the second elastic return system.

At least one slide 11, 12 is formed by two portions bounding each other by one or the other of the slides 11, 12. For example, the slide 12 is formed by two portions 12*a*, 12*b* bounded by the slide 11. Like the first embodiment, the friction elements 13, 14 are respectively coincident with the slides 11, 12. Thus, one distinguishes friction elements 14*a*, 14*b* on each of the portions 12*a*, 12*b* of the slide 12. For this, the slide 11, 12*a*, 12*b* or the friction element 13, 14*a*, 14*b* is returned by an elastic element or elastic return system which comprises an elastic blade integrated with the frame 17 of the element 10. More particularly, each slide flank may be integrated with an elastic blade designed to return the elements 11, 12 or 13, 14 in a state of cooperation with one or the other of the slide elements 22, 32 of the shafts 21, 31, particularly in contact with one or the other of the slide elements 22, 32 of the shafts 21, 31.

Thus, the first shaft and the second shaft extend, in the direction of the first axis or the second axis, on axial portions Z1 and Z2 which are totally or partly overlapping.

Figure 13:
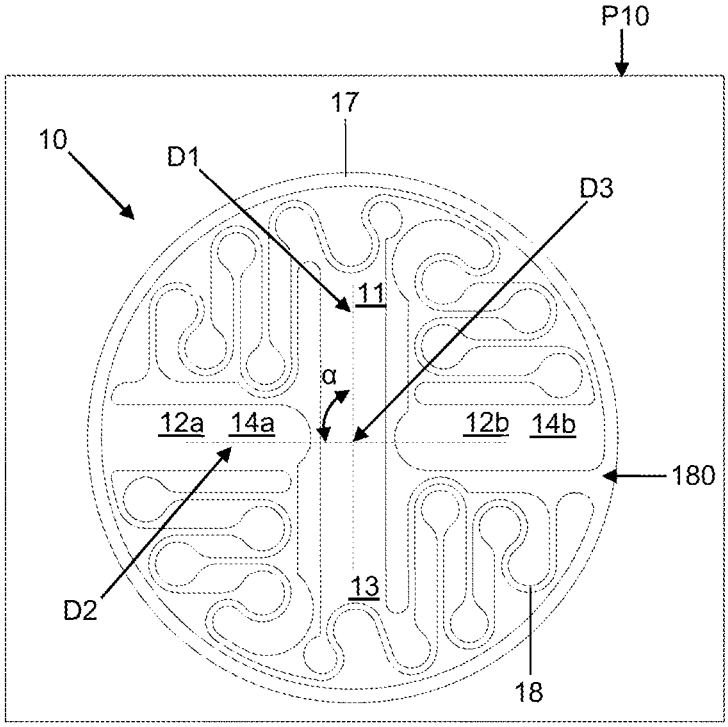
Figure 14:
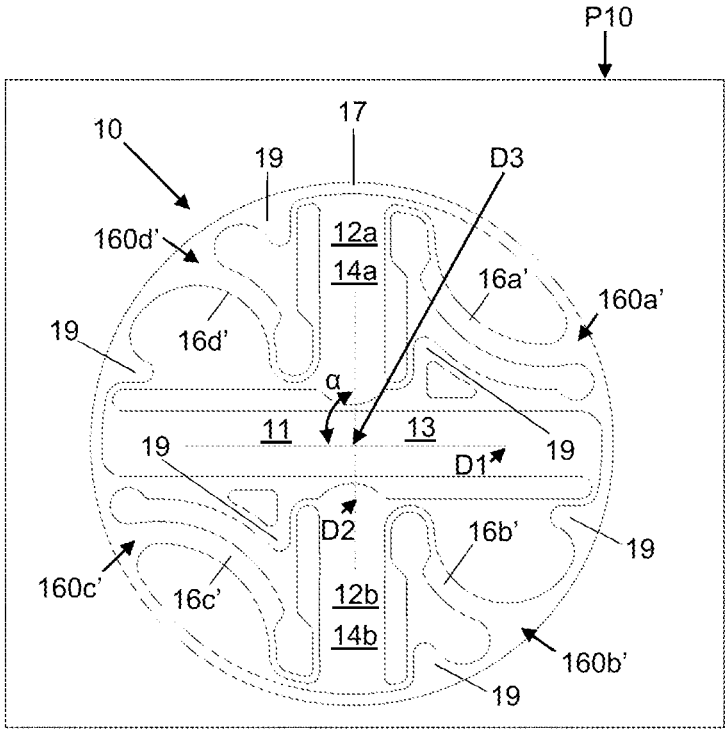

In the first and second variants of the second embodiment, represented in detail in FIGS. 13 and 14, the first elastic return system has one or more first elastic blades designed in particular to elastically return a slide 11, especially each of the flanks of the groove 11. The second elastic return system has one or more second elastic blades designed in particular to elastically return the slide portions 12*a*, 12*b*, especially each of the flanks of the slide portions 12*a*, 12*b*.

FIGS. 13 and 14 illustrate two first design variants of the element 10 according to the second embodiment. The variants are distinguished by the arrangements of the elastic blades, which are different. In the first variant, the slides, the friction elements and the elastic elements are made continuous with one another. Thus, one notices a monolithic network 18 of elastic blades joined to a frame 17 in the area of its end 180. In the second variant, one distinguishes elastic blades 16*a*'-16*d*' each of them being integrated, at a first end, with each of the flanks of the portions 12*a*, 12*b* of the slide 12. These elastic blades are each joined to the frame 17 in the area of a second end 160*a*'-160*d*'. Advantageously, abutments 19 bounding the slides 11, 12 are provided so as to prevent any risk of plasticization of the blades 16*a*'-16*d*'. Thus, in the second variant of the second embodiment, the first elastic return system comprises at least one first abutment 19 limiting the deformation of the first elastic return system and/or the second elastic return system comprises at least one second abutment 19 limiting the deformation of the second elastic return system.

In variants which are not represented, the element 10 might not have a frame 17.

The network 18 or the blades 16*a*'-16*d*' may of course have variations in cross section, in particular necks, in order to adjust the friction torque against the slide element 22 and/or the slide element 32. Preferably, like the first embodiment, the friction torque generated is of the order of 0.1 to 5 pNm, or of the order of 1 to 5 pNm.

Figure 15:
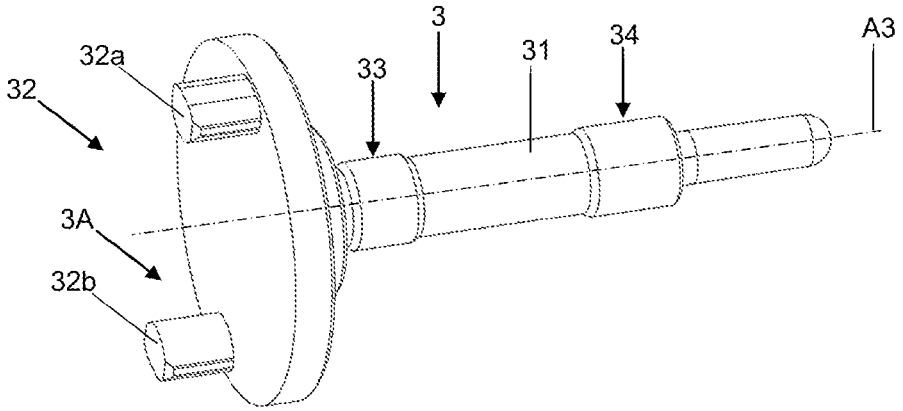
Figure 16:
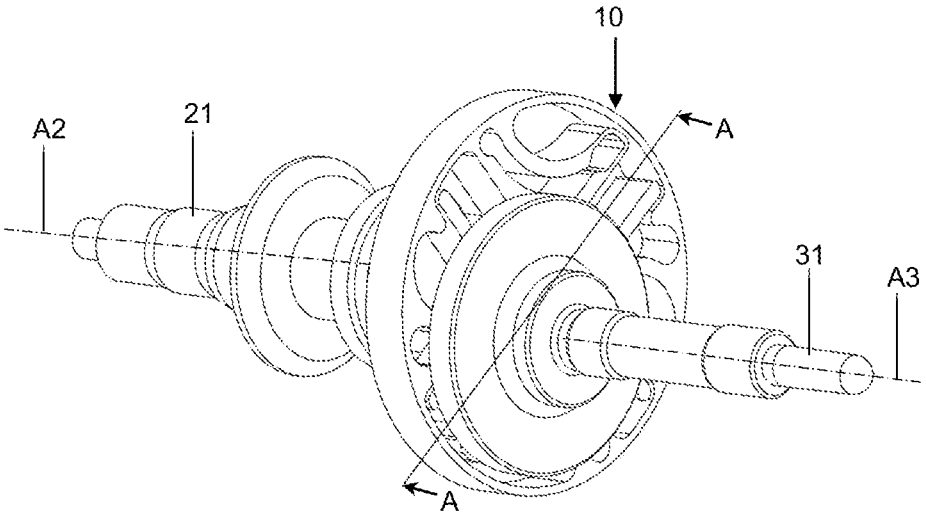

In order to allow an adequate cooperation between the slide 12 and the slide element 32, the latter is made of two parts 32*a*, 32*b* whose geometries are complementary to those of the portions 12*a*, 12*b* of the slide 12. For example, the parts 32*a*, 32*b* may be present in the form of pads or pegs 32*a*, 32*b* as represented in FIGS. 15 and 17.

A third variant of the second embodiment of the linkage element 10, and more generally a third variant of the second embodiment of the transmission coupling, is described below with reference to FIGS. 18 to 21.

This third variant differs from the first and second variants described above in that the linkage element has rigid grooves, that is, grooves with nondeformable flanks (during normal use of the element). Thus, the elastic return systems may be offset on the shafts 21 and 31, in particular at the ends of the shafts 21 and 31.

Figure 19:
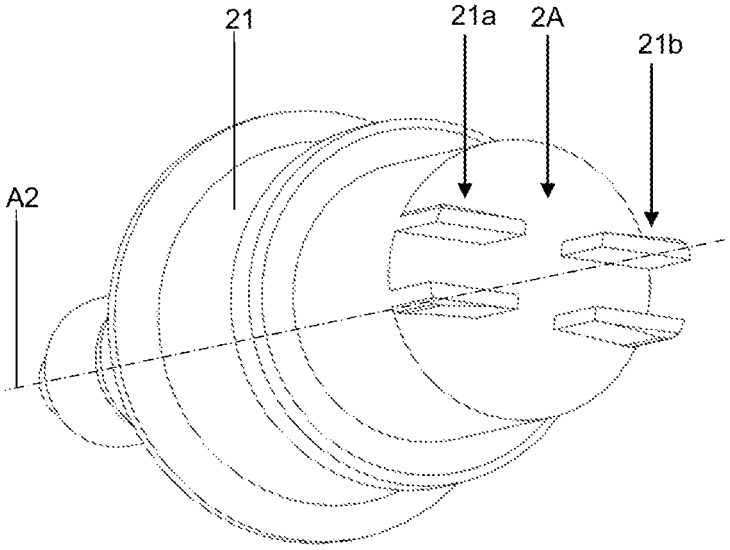
Figure 20:
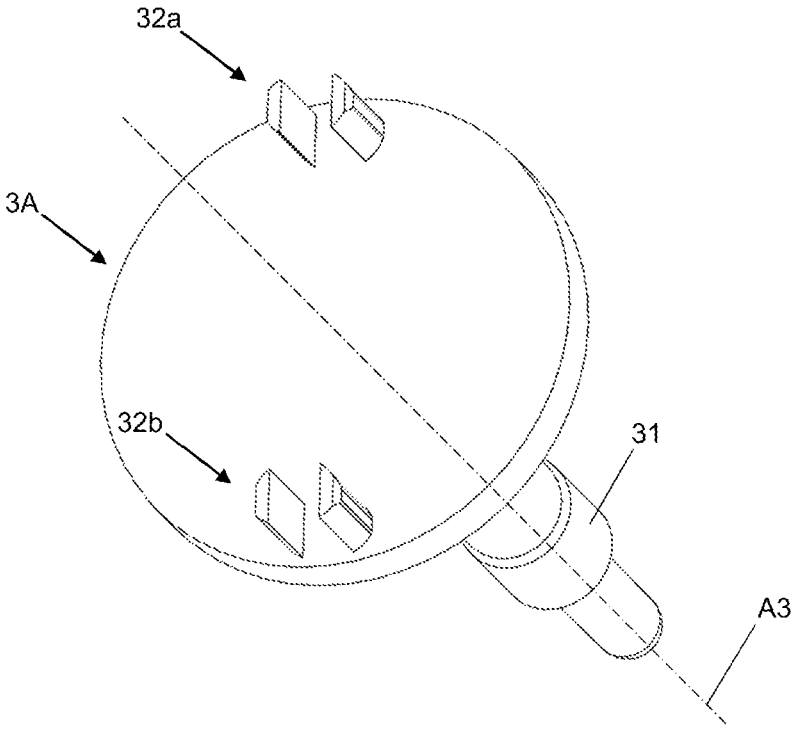

As can be seen in FIGS. 19 and 20, it is the first part of the first shaft 2A and the second part of the second shaft 2B which may have the elastic return systems.

A first elastic return system is made of two pairs of projections or strips 21*a* and 21*b*.

A second elastic return system is made of two pairs of projections or strips 32*a* and 32*b*.

These pairs of strips may each be made from a split pin.

These strips are each elastically deformed when they are in place in the grooves of the linkage element. In other words, these strips are each elastically prestressed when they are in place in the grooves of the linkage element.

Figure 21:
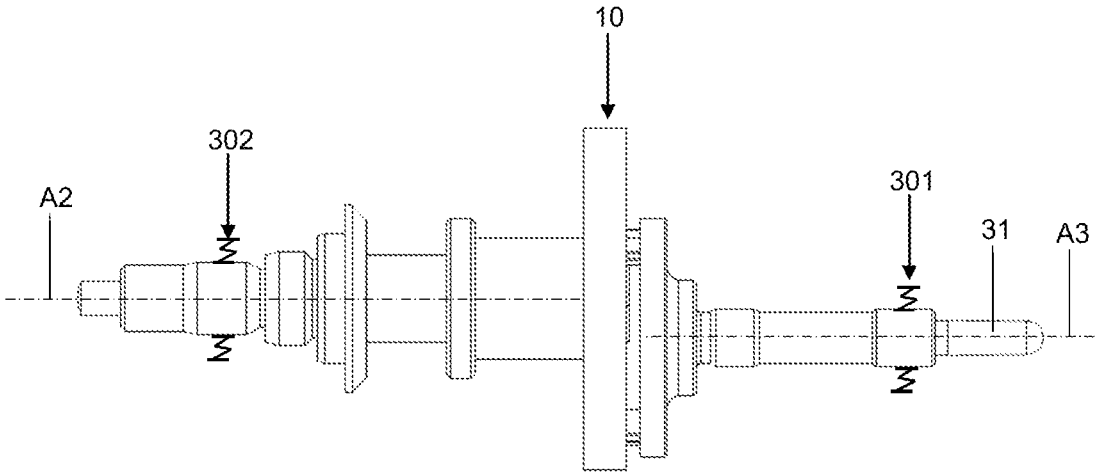
FIGS. 21 and 22 illustrate a fourth variant of the second embodiment of the transmission coupling.

Alternatively or supplementally, as can be seen in FIG. 21, the shafts 21, 31 may respectively cooperate with friction elements 301, 302. More generally, the moving parts 2, 3 may respectively cooperate with friction elements 301, 302. These friction means 301, 302 may be present for example in the form of a foil. A single foil 301, 302 may be enough to generate an adequate friction torque.

In the first three variants of the second embodiment, the slideways are rectilinear. They each allow a sliding along a line.

The operating principle of the transmission coupling according to the second embodiment is similar to that of the transmission coupling according to the first embodiment.

Figure 22:
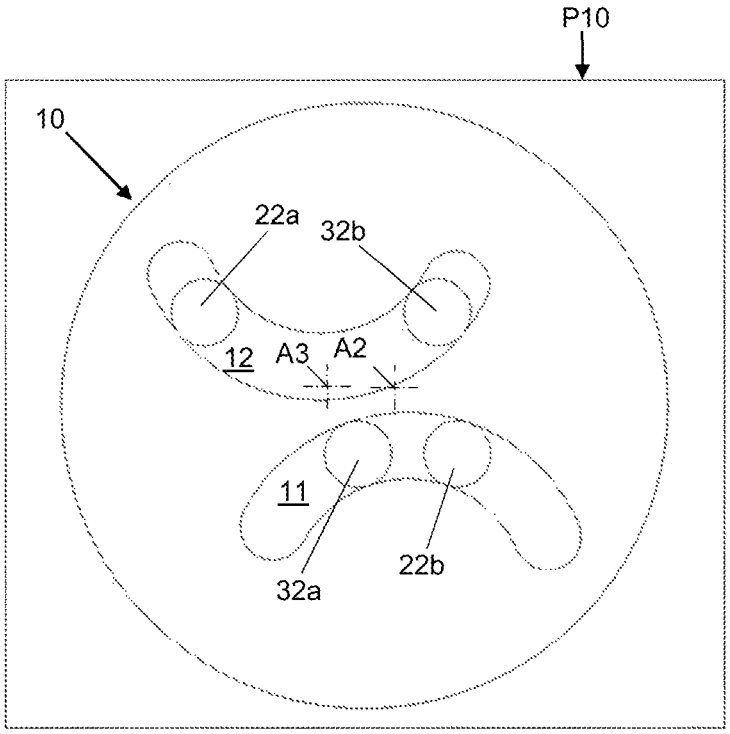
Figure 23:
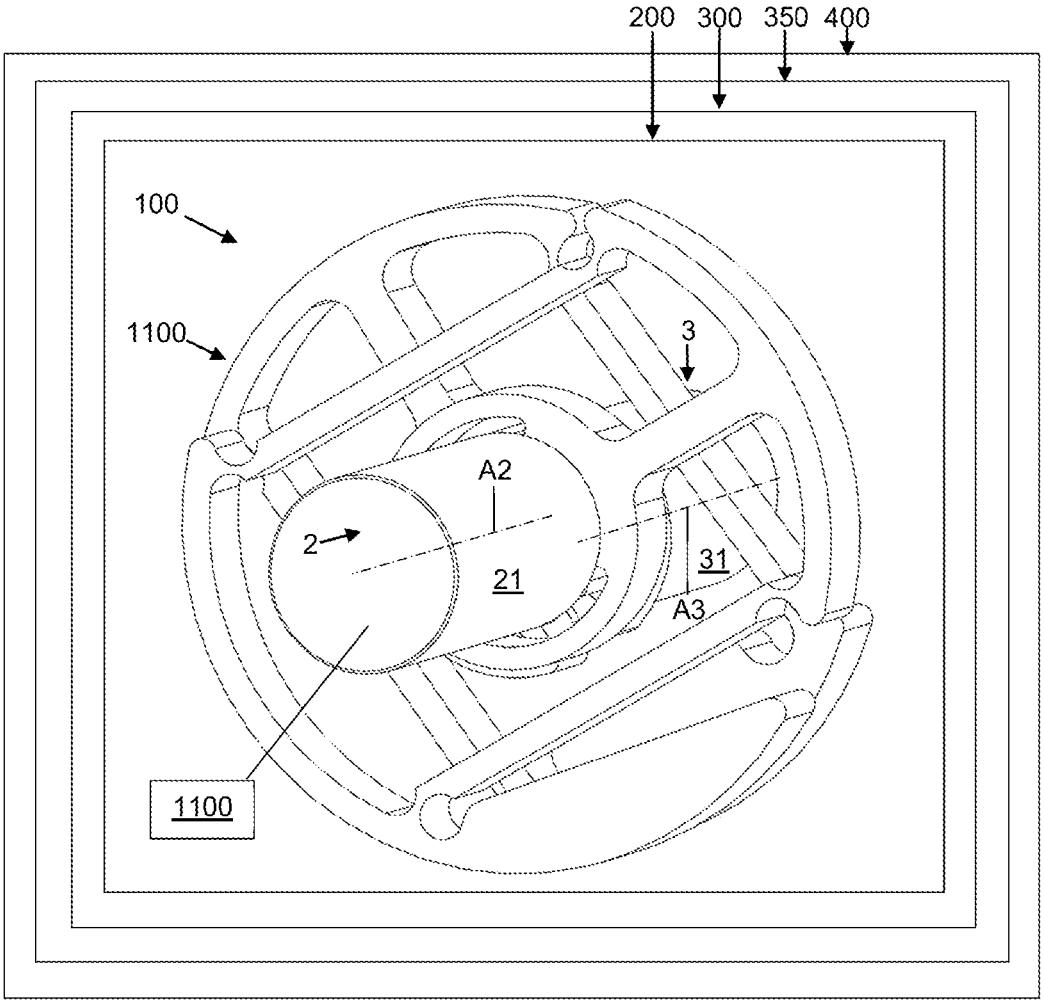
FIGS. 23 to 26 illustrate a third embodiment of a timepiece.

A fourth variant of the second embodiment of the linkage element 10 and more generally a fourth variant of the second embodiment of the transmission coupling is described below with reference to FIG. 22.

This fourth variant differs from the first, second and third variants described above in that the linkage element has hollow sliding elements, in particular grooves 11, 12 which are not rectilinear. In fact, the grooves of the slideways are curved, particularly in the form of a circle arc or substantially in the form of a circle arc. Furthermore, the grooves do not intercept each other.

The shafts 21 and 31 each comprise two pins arranged axially at one of their ends.

The hollow sliding element 11 is provided to receive a projecting sliding element 22*b*, 32*a*, particularly a pin, of each shaft 21, 31.

The hollow sliding element 12 is provided to receive a projecting sliding element 22*a*, 32*b*, particularly a pin, of each shaft 21, 31.

The operation of this variant embodiment is based on the fact that the driving shaft, such as the shaft 21, drives in rotation the linkage element by action of the pins 22*a* and 22*b* on the respective flanks of the grooves 11, 12 and the linkage element drives in rotation the driven shaft by action of the respective flanks of the grooves 11, 12 on the pins 32*a* and 32*b*, the pins being displaced in the grooves 11 and 12.

Unlike the other aforementioned variants, each of the sliding elements of the shafts 21, 31 interact with two sliding elements 11, 12 of the element 10.

The first and/or second elastic return systems as in the other embodiments and variants may be arranged on the linkage element and/or on the shafts.

A third embodiment of a timepiece 400 is described below with reference to FIGS. 23 to 26.

This third embodiment differs from the first embodiment in the area of the transmission coupling.

As in the first embodiment, the coupling is arranged so as to mechanically link at least one first part 2A of the first shaft, here a first end, such as a cylindrical end of the first shaft, which is at least movable in rotation about a first axis A2, to at least one second part 3A of the second shaft, here a second end, such as a cylindrical end of the second shaft, which is at least movable in rotation about a second axis A3. The first and second axes are parallel or substantially parallel. They are thus off-center. The transmission coupling comprises the at least one first part 2A of the first shaft and the at least one second part 3A of the second shaft. The shafts 21, 31 here are movable in rotation respectively about axes A2, A3.

The transmission coupling comprises at least a first elastic return system 111 arranged so as to cancel out the play between the first shaft part 2A of the first shaft and the second shaft part 3A of the second shaft. The first return system 111 mechanically connects the first shaft part 2A of the first shaft and the second shaft part 3A of the second shaft. The first return system 111 is part of a linkage element 110.

The transmission coupling comprises a second elastic return system 112 arranged so as to cancel out the play between the first shaft part 2A of the first shaft and the second shaft part 3A of the second shaft. The second return system 112 mechanically connects the first shaft part 2A of the first shaft and the second shaft part 3A of the second shaft. The second system 112 is part of the linkage element 110.

Thus, the transmission coupling comprises the linkage element 110 arranged at the interface of the respective shafts 21, 31 of two moving parts 2, 3, in particular at the interface between the first shaft part 2A of the first shaft and the second shaft part 3A of the second shaft.

Thus, in the third embodiment of the transmission coupling, the linkage element 110 is provided with linkage elements 111, 112 whose operating principle is similar to that known for Schmidt couplings. These linkage elements 111, 112 are each connected to receiving elements 113, 114 of the shafts 21, 31 of the moving parts 2, 3, in particular the ends of the shafts 21, 31.

The element 110 has two portions 11*a*, 11*b* arranged respectively in two parallel planes P11, P12. These planes P11 and P12 are preferably perpendicular to the axes A2 and A3.

The first portion 11*a* comprises first linkage elements 111 being present in the form of two flexible arms 111*a*, 111*b* which are parallel or substantially parallel. The flexibility of each of the arms 111*a*, 111*b* is realized by flexible necks 111*aa*, 111*ab*; 111*ba*, 111*bb* situated at the ends of each of said arms. Thus, each of the arms 111*a*, 111*b* is able to move in translation or substantially in translation next to a frame 115 of the portion 11*a*. These arms 111*a*, 111*b* are likewise connected by an arm 116 supporting the receiving element 113 of the first shaft. Thus, the arm 116 may be likened to a table with four circular necks such that the receiving element 113 can move next to the frame 115. The movement of the receiving element 113 relative to the frame 115 comes close to a movement of translation, in particular one of slight amplitude.

The structure of the portion 11*b* is similar to that of the portion 11*a*. The latter has two linkage elements 112 which are present in the form of two flexible arms 112*a*, 112*b* which are parallel or substantially parallel. The flexibility of each of the arms 112*a*, 112*b* is realized by flexible necks 112*aa*, 112*ab*; 112*ba*, 112*bb* situated at the ends of each of said arms. Thus, each of the arms 112*a*, 112*b* is able to move in translation or substantially in translation next to a frame 117 of the portion 11*b*. These arms 112*a*, 112*b* are likewise connected by an arm 118 supporting a receiving element 114 of a second shaft. Thus, the arm 118 may be likened to a table with four circular necks such that the receiving element 114 can move next to the frame 117. The movement of the receiving element 114 relative to the frame 117 comes close to a movement of translation, in particular one of slight amplitude.

Thus, the first elastic return system 111*a*, 111*b* comprises at least one elastically deformable arm. Likewise, the second elastic return system 112*a*, 112*b* comprises at least one elastically deformable arm.

Preferably, each portion 11*a*, 11*b* is present in the form of a monobloc or integrated subassembly. The portions 11*a*, 11*b* may be joined by welding, especially by laser welding, in particular in the area of the frames 115, 117. Preferably, these frames or one or the other of the frame has an extra thickness such that the arms can move without rubbing against each other. The frame 115 here has an extra thickness 115*a*.

Figure 24:
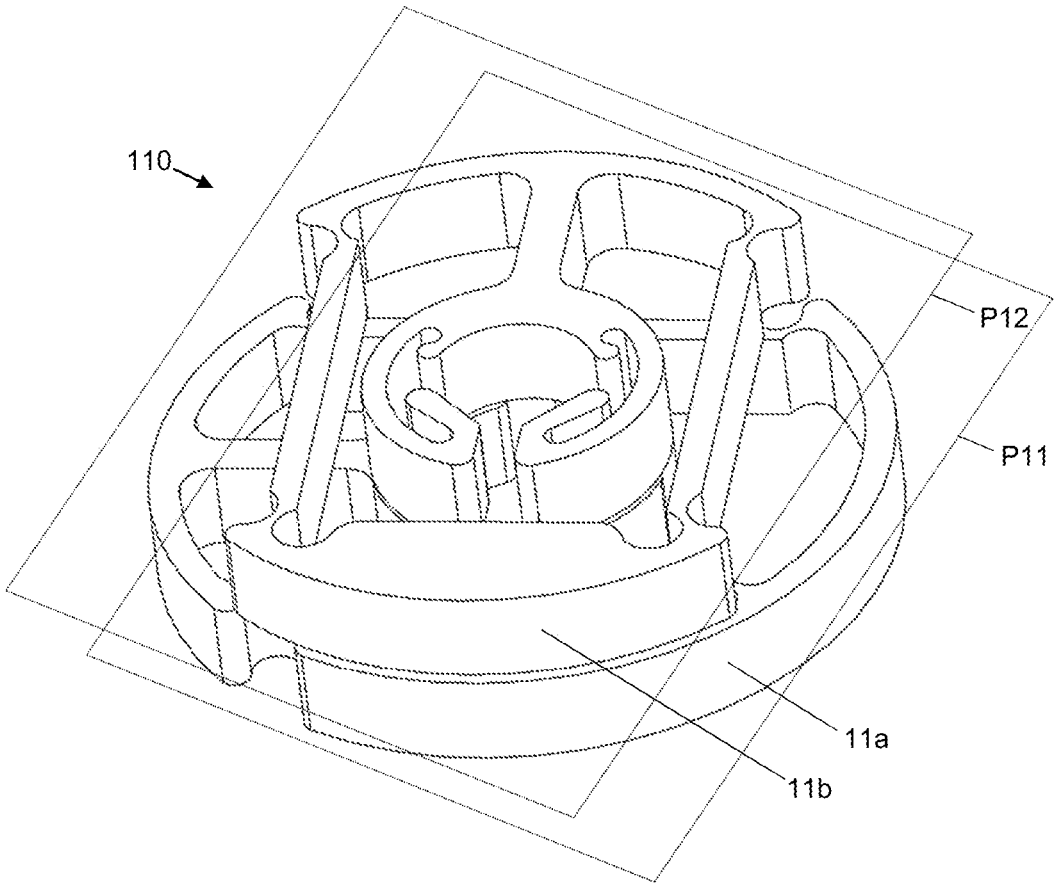
Figure 25:
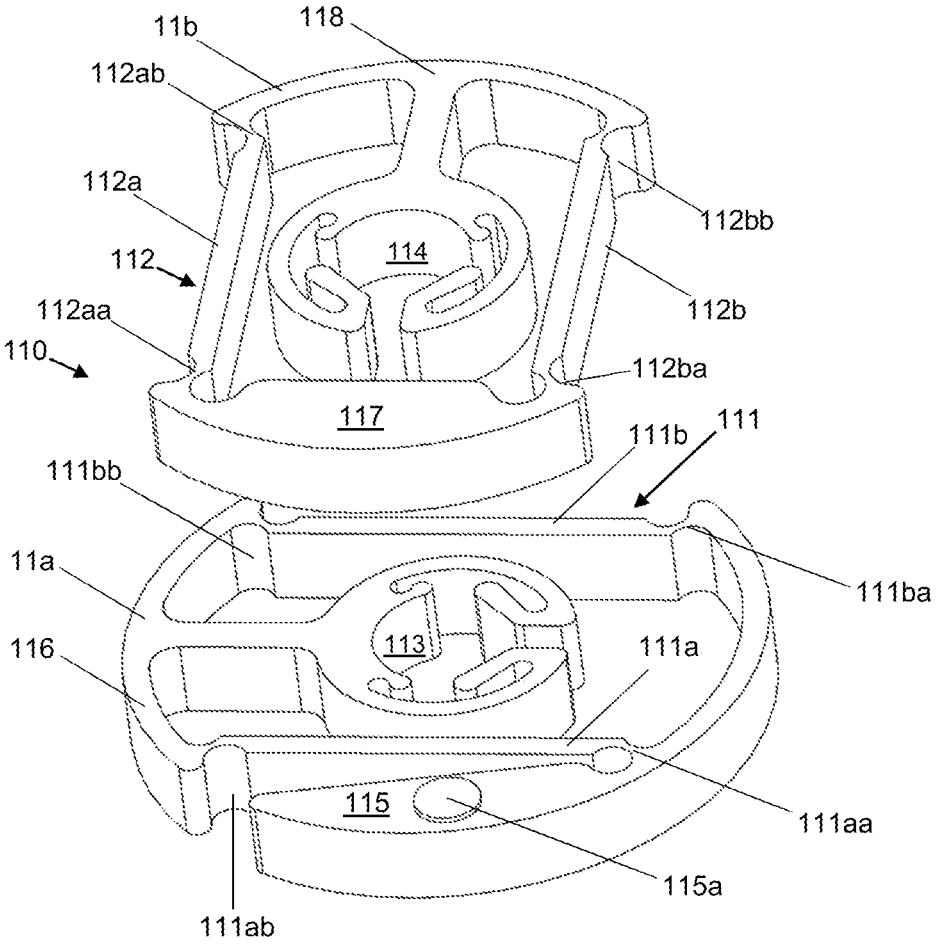

The portions 11*a*, 11*b* here are mounted one on the other such that the arms 111*a*, 111*b*, 112*a*, 112*b* can move in translation in orthogonal or substantially orthogonal directions. Before assembling the transmission device, the element 110 has concentric or substantially concentric receiving elements 113, 114, as represented in FIG. 24, where the arms 111*a*, 111*b*, 112*a*, 112*b* are at rest.

Figure 26:
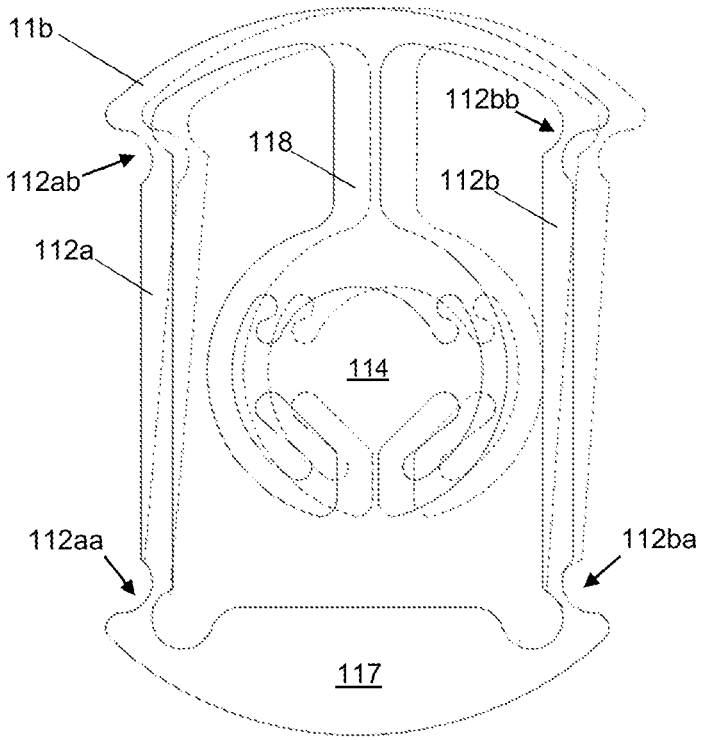
Figure 27:
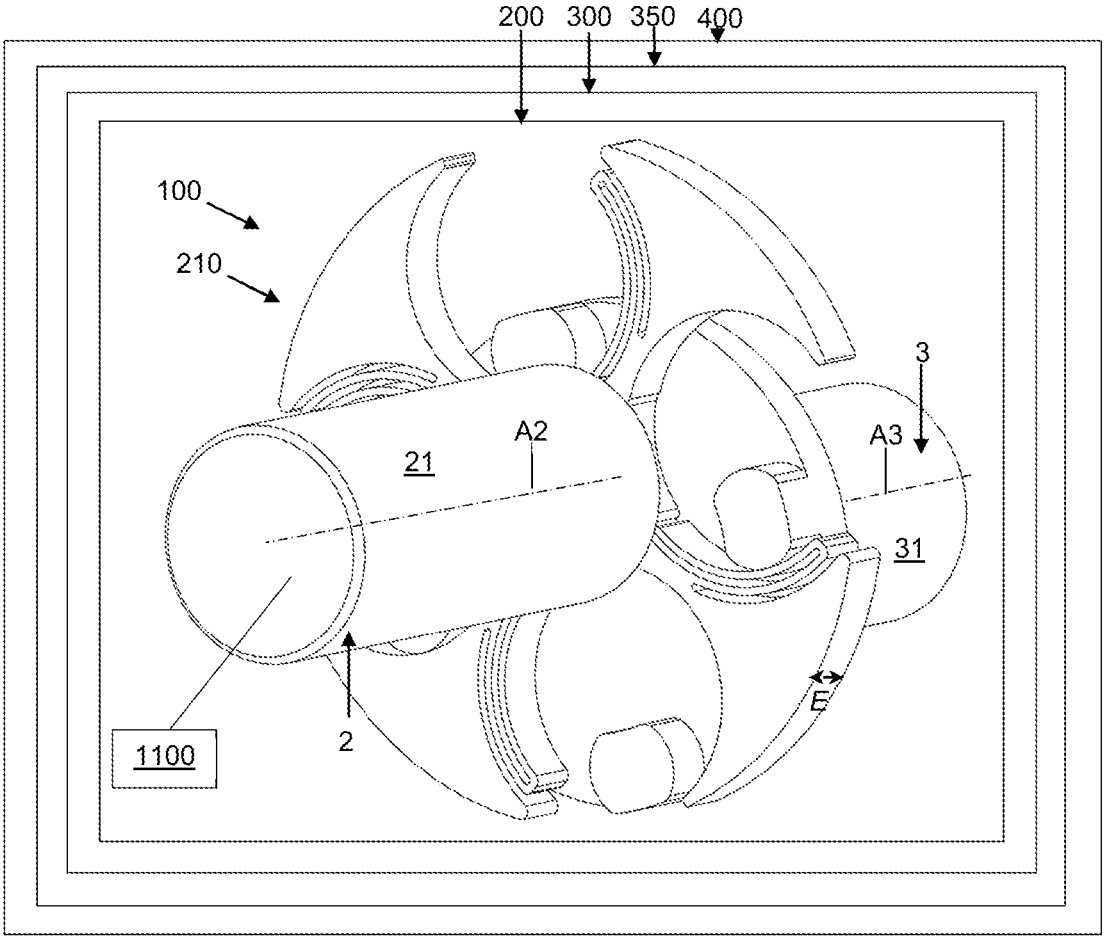
FIGS. 27 to 31 illustrate a fourth embodiment of a timepiece.
Figure 28:
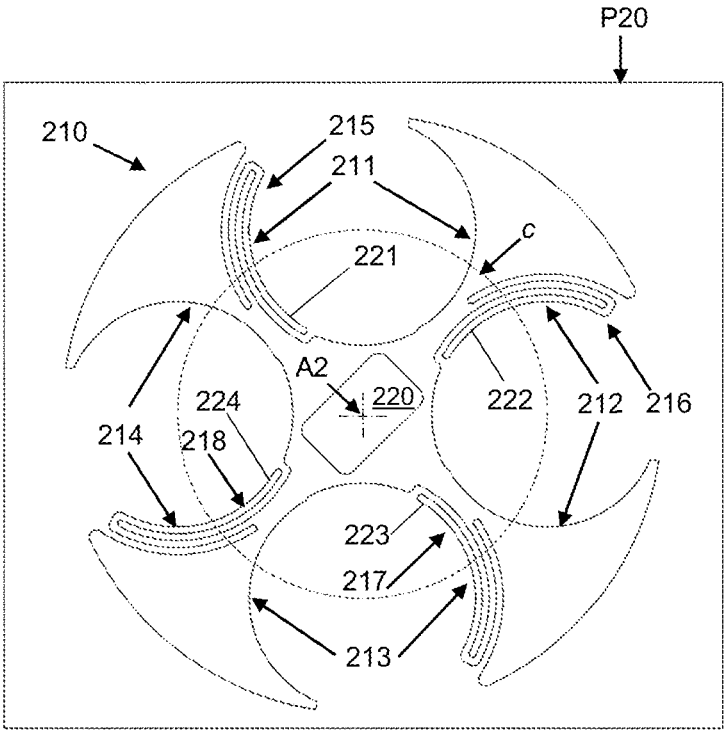
Figure 29:
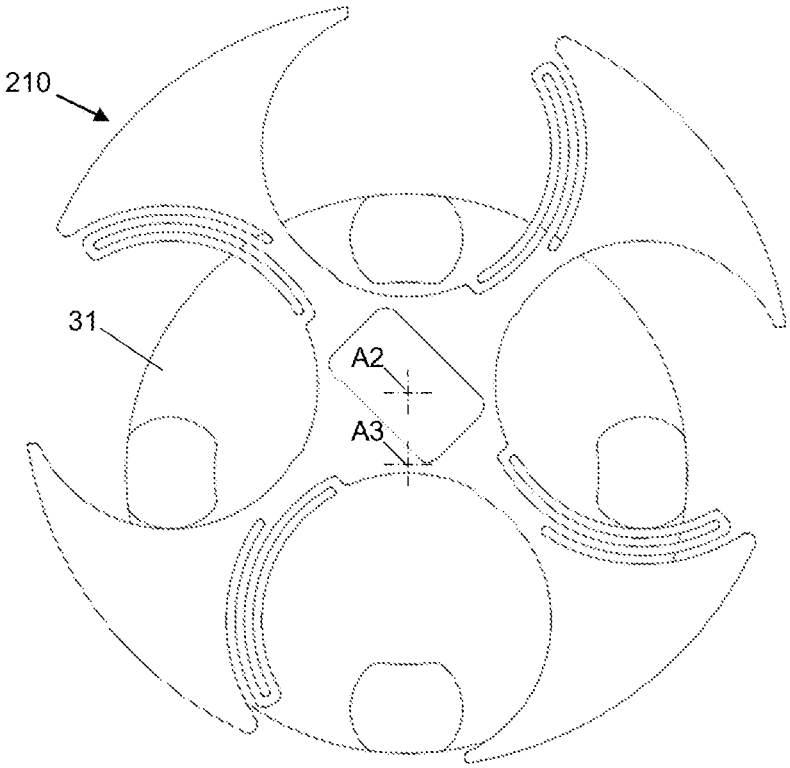
Figure 30:
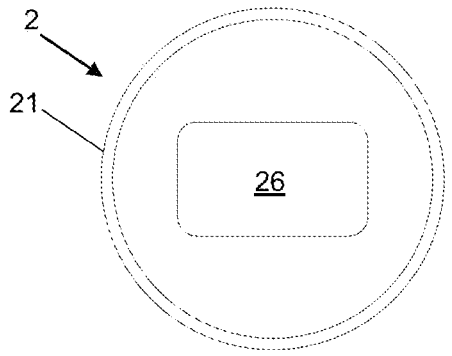
Figure 31:
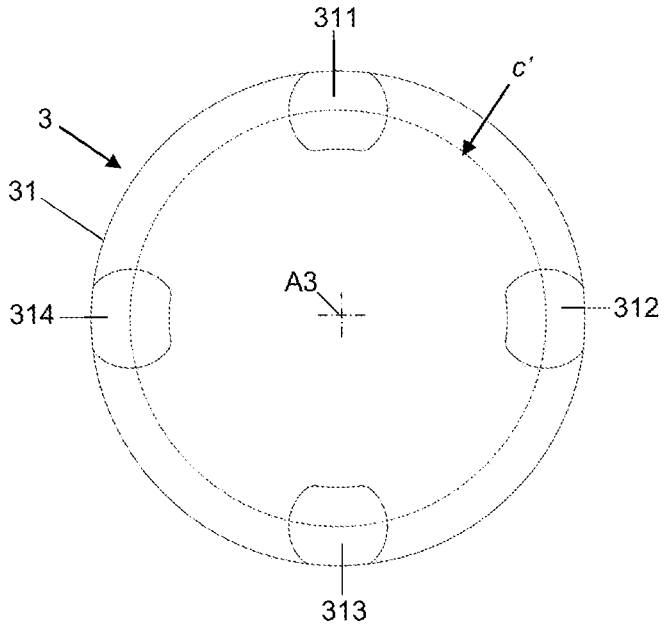

During the assembling of the transmission device, the receiving elements 113, 114 are moved apart from one another such that each of these receiving elements is joined to one or the other of the shafts 21, 31 of the moving parts 2, 3. This moving apart by a distance corresponding to the one separating the axis A2 from the axis A3 causes the displacement of the arms 111*a*, 111*b*, 112*a*, 112*b* and an accumulation of an elastic potential energy in the area of each of the flexible necks. As an example, FIG. 26 illustrates the portion 11*b* in two states of displacement of the arms 112*a*, 112*b*.

Thus, the transmission coupling comprises the first receiving element and the at least one first elastic return system is arranged so as to be deformable in order to position the first receiving element along the first axis.

In similar fashion, the transmission coupling comprises the second receiving element and the second elastic return system is arranged so as to be deformable in order to position the second receiving element along the second axis.

The receiving elements may comprise tongs with elastic jaws. In operation of the transmission device, the arms 111*a*, 111*b*, 112*a*, 112*b* are displaced along their respective flexible necks while remaining parallel or substantially parallel to each other. The displacement in two orthogonal or substantially orthogonal directions of the arms 111*a*, 111*b*, 112*a*, 112*b* provides a linkage element 110 which is able to connect homokinetically two moving parts whose axes of rotation are parallel or substantially parallel and close together. Advantageously, the elastic potential energy accumulated by the return elements in the form of flexible necks makes it possible to connect the moving parts 2 and 3 with less play, in particular with less angular play. Thus, the element 110 can connect homokinetically two moving parts 2, 3 whose axes A2, A3 of rotation are parallel or substantially parallel and close together, while minimizing as much as possible the angular play at the interface of the shafts 21, 31.

Further advantageously, the elastic potential energy accumulated by the linkage element 110 during the assembling of the transmission device remains constant during the operation of the transmission device, since the angular displacements of the arms 111*a*, 111*b*, 112*a*, 112*b* are out of phase by 90° during the rotation of the shafts 21, 31.

Preferably, the receiving elements 113, 114 have a flexible structure so as to enable an assembly with the rest of the shafts 21, 31 by driving in the ends.

Like the elements of the first embodiment, the subassemblies 11*a*, 11*b* or the element 110 are preferably made of silicon and/or coated silicon, especially coated with silicon dioxide or silicon nitride, or nickel or a nickel-phosphorus alloy. Of course, the subassemblies 11*a*, 11*b* or the element 110 may alternatively be made of a totally different material, especially any other elastic material, such as a metallic glass or even a polymer.

These subassemblies 11*a*, 11*b* can be made of the same material, or not. These subassemblies or this element can be fabricated preferably by electroforming or by etching. Alternatively, such components could be machined by electro-erosion or even by laser. The subassemblies 11*a*, 11*b* may be joined, especially in the area of the frame 115, by gluing, welding, brazing or any other adapted method.

In one alternative variant embodiment of the third embodiment, the element 110 may comprise two portions 11*a*, 11*b* situated in the same plane. This plane is preferably perpendicular to the axes A2 and A3. In this variant, the arms 111*a*, 111*b* have a length different from that of the arms 112*a*, 112*b* such that the first or the second elastic return system can be disposed in the same plane as the second or the first elastic return system. The receiving elements 113, 114 may be adapted to occupy the same plane, and may be present for example in the form of pairs of bores or projections positioned perpendicularly.

A fourth embodiment of a timepiece 400 is described below with reference to FIGS. 27 to 31.

This fourth embodiment differs from the first embodiment in the area of the transmission coupling.

As in the first embodiment, the coupling is arranged so as to mechanically link at least a first part 2A of the first shaft which is at least movable in rotation about a first axis A2 to at least one second part 3A of the second shaft which is at least movable in rotation about a second axis A3. The first and second axes are parallel or substantially parallel. In this embodiment, the at least one first part 2A of the first shaft is a plate or a disk 210 mounted at the end of the rest of the shaft 21. However, the first part may be integrated with the rest of the first shaft. The first part and the rest of the shaft may thus together form the first shaft, this first shaft being monobloc. In this embodiment, the at least one second part 3A of the second shaft is monobloc with the rest of the second shaft. The second shaft part and the rest of the second shaft thus together form the second shaft.

The shafts 21, 31 here are movable in rotation respectively about the axes A2, A3.

The transmission coupling comprises at least one first elastic return system 221 arranged so as to limit or cancel out the play between the at least one first part 2A of the first shaft and the at least one second part 3A of the second shaft. The at least one first return system mechanically connects the at least one first part 2A of the first shaft and the at least one second part 3A of the second shaft.

The transmission coupling comprises at least one linkage element 210 arranged at the interface of the respective shafts 21, 31 of two moving parts 2, 3, particularly at the interface between the first part 2A of the first shaft and the second part 3A of the second shaft.

The linkage element 210 or frame 210 is joined firmly in rotation with one or the other of the shafts 21, 31. In the embodiment represented, the element 210 is joined firmly in rotation with the shaft 21 in the area of one end 26 of the shaft 21. This end 26 may have a noncircular cross section and cooperate with a geometry 220 complementary to that of the element 210 so as to allow the transmission of a torque from the shaft 21 to the element 210. Thus, the element 210 here is joined firmly in rotation with the moving part 2 and is thus movable in rotation about the axis A2. This element 210 is advantageously formed in a single plane P20.

The element 210 has curved cam surfaces 211, 212, 213, 214, arranged in the same plane P20, which are provided to cooperate respectively with pads 311, 312, 313, 314 provided on the second part 3A of the second shaft 31. In the embodiment shown, the surfaces 211, 212, 213, 214 are portions of circles centered on the same circle c, itself centered on the axis A2. As for the pads 311, 312, 313, 314, these are situated on the same circle c', which is centered on the axis A3. The radii of the circles c and c' are preferably equal or substantially equal. The cam surfaces and the pads are preferably equally spaced respectively about axes A2, A3. The cooperation of the surfaces 211, 212, 213, 214 and the pads 311, 312, 313, 314 thus drives the moving part 3 in a movement of rotation about the axis A3.

The surfaces 211, 212, 213, 214 may cooperate with each of the pads 311, 312, 313, 314 in simultaneous manner or not. Preferably, only two cam surfaces cooperate simultaneously with their respective pad.

Preferably, the surfaces 211, 212, 213, 214 respectively have friction elements 215, 216, 217, 218. Each friction element 215, 216, 217, 218 is arranged such that it is elastically returned against a pad by an elastic return element 221, 222, 223, 224. Each elastic return element is preferably present in the form of an elastic blade 221, 222, 223, 224. Advantageously, at least one friction element is always in contact with a pad, regardless of the angular position of the linkage element 210. Such a solution is thus able to eliminate the angular play at the interface of the shafts 21, 31, while avoiding any risk of static indeterminacy liable to affect the homokinetic nature of the transmission device of which the linkage element is a part.

Thus, the frame comprises the first part 2A of the first shaft and at least one cam surface 211, 212, 213, 214, especially at least one circular opening, designed to cooperate with at least one peg provided on the second shaft, the first elastic return system 221, 222, 223, 224 of the frame comprising at least one elastic blade provided on the at least one cam surface.

Advantageously, the frame has N cam surfaces and/or N elastic blades arranged in a symmetry of rotation of order N, where N is a whole number greater than or equal to 2. Preferably, N=2 or N=3 or N=4.

Alternatively, the friction elements might be supported by the pads.

Like the elements of the aforementioned embodiments, the element 210 is preferably made of silicon and/or coated silicon, especially coated with silicon dioxide or silicon nitride, or nickel or a nickel-phosphorus alloy. Of course, the element 210 may alternatively be made of a totally different material, especially any other elastic material, such as a metallic glass or even a polymer. This element may preferably be made by electroforming or by etching. Alternatively, it may be machined by electro-erosion or even by laser.

As previously seen, in the different embodiments and in the different variants, a transmission coupling is able to connect kinematically, especially homokinetically, two moving parts whose axes of rotation are parallel or substantially parallel and close together.

Such a transmission coupling may, for example, be implemented advantageously within a timepiece having a modular analog display in which the axis of rotation of a first moving display part indicating the time or information based on the time is displaceable next to the axis of rotation of a second moving part of a watch movement providing said time indication or information based on the time. The transmission coupling may in particular be integrated within a chronograph mechanism. Of course, the transmission coupling may, however, be used to set off any second moving part of a watch relative to a first moving part of a watch. The moving part is not necessarily an element of the movement. For example, it could comprise a winding stem so as to provide a transmission device which is improved with regard to the device disclosed in document EP2275883, in which a movement stem is linked mechanically to a housing stem via a transmission coupling. The solutions described above may likewise be used to link two moving parts involved in the covering of a watch, especially a wristwatch, and may be used to connect a shaft to a flange or to a rotating bezel or to any other shaft.

Different embodiments and different variants of the transmission coupling comprise slideways. Each slideway comprises a hollow sliding element and a projecting sliding element. Flanks of the hollow element and flanks of the projecting sliding element cooperate by contact to provide the guiding as defined by the slideway. If two parts are joined to each other or guided in relation to one another by a slideway linkage, the hollow element and the projecting element may be placed either on one or the other of the two parts, as long as a projecting element is located on one of the parts and the hollow element cooperating with that projecting element is placed on the other of the parts. A hollow element advantageously comprises one or more grooves. A projecting element advantageously comprises one or more parallelepiped shapes or several pads or several pegs. In advantageous fashion, an elastic return system is associated with each slideway so as to limit or cancel out the play between the projecting element and the hollow element of the slideway.

Advantageously, the elastic return system may be such that the projecting element has a dimension greater than a dimension of the hollow element so that the projecting element and/or the hollow element is elastically deformed when the projecting element is introduced into the hollow element. This deformation preferably involves multiple contacts between the flanks of the projecting element and the flanks of the hollow element. The elastic return system preferably comprises one or more elastic blades or elastic tabs. These blades or tabs may directly form flanks or portions of flanks of a hollow element or directly form flanks or portions of flanks of a projecting element. Alternatively or supplementally, the blades or tabs may form supports of the flanks or portions of flanks of a hollow element or form supports of the flanks or portions of flanks of a projecting element.

In the first two embodiments and in the different variants of a transmission coupling, the transmission coupling may have:

- a first elastic return system on the linkage element in the area of a first slideway; and/or
- a second elastic return system on the linkage element in the area of a second slideway; and/or
- a third elastic return system on the first shaft in the area of the first slideway; and/or
- a fourth elastic return system on the second shaft in the area of the second slideway.

Each of these return systems may comprise an abutment to limit the deformation of the elastic return system.

The reducing, or even cancellation of the play between the at least one first part of a first shaft and the at least one second part of a second shaft, or between the first and second moving parts, is an important feature contributing to the homokinetic nature of the transmission coupling. In fact, one thus avoids non-homokinetic phases of taking up where the at least one first part of the first shaft is turning while the at least one second part of the second shaft remains motionless.

In the different embodiments and in the different variants of a clock mechanism comprising a transmission coupling, the mechanism may comprise at least one friction element 301, 302 (as shown in FIG. 21 with regard to the second embodiment). The at least one friction element may be a foil 301 arranged in contact with a shaft or, more generally, any element taking part in the moving part with which the shaft is associated or takes part. The mechanism may also comprise a first foil 302 arranged in contact with the first shaft 21 and a second foil 301 arranged in contact with the second shaft 31. Such a friction element may replace the first elastic return system on the linkage element in the area of a first slideway or the second elastic return system on the linkage element in the area of a second slideway or the third elastic return system on the first shaft in the area of the first slideway or the fourth elastic return system on the second shaft in the area of the second slideway.

In the different embodiments and in the different variants, the at least one first return system makes it possible to return the second moving part in a unique position depending on the position in which the first moving part finds itself. Thus, the first return system is able to match up any position of the first moving part with a unique position of the second moving part. This function can be provided by the first return system. In certain embodiments, this function may be provided jointly by the first return system and by the second return system.

By "moving part" is meant preferably in this entire document a wheel or a pinion or an assemblage of wheels and/or pinions, or a display element or an assemblage of wheels and/or pinions and/or display elements. A "moving part" comprises a shaft which may be fabricated with one or the other of the aforementioned elements or form a full component.

By "transmission coupling" is meant preferably in this entire document a transmission device making it possible to:

link two shafts in rotation end to end or substantially end to end; and/or link two parallel or substantially parallel shafts in rotation; and/or transmit a movement of homokinetic rotation or substantially homokinetic rotation between two shafts; and/or transmit a movement of rotation without speed multiplication or demultiplication between two shafts; and/or transmit a movement of rotation between two shafts, the shafts turning in the same direction.

The term "transmission coupling" excludes a rigid assemblage between two aligned shafts, in particular a rigid sleeve or a spline sleeve rigidly connecting two aligned shafts. The term "transmission coupling" also excludes a transmission by toothed wheels. The transmission coupling allows the transmission of a movement of rotation from a first shaft to a second shaft, the second shaft being off-center relative to the first shaft. However, the transmission coupling also allows the transmission of a movement of rotation from a first shaft to a second shaft, the first shaft and the second shaft being coaxial.

By "frame" is meant preferably in this entire document any portion of a linkage element enabling the mechanical connecting in complete linkage of:

two sliding elements of two different slideways, and/or two elastic return systems, and/or two elements of an elastic return system.

Thus, the frame is advantageously a part structurizing the linkage element. For example, the frame generally has the shape of a disk or a circular ring.

By "at least one shaft part" is meant preferably in this entire document any part of a shaft, even if this part is mounted on the rest of the shaft and can be dismounted afterwards, assuming however that in a normal operation of the shaft the part is in complete linkage with the rest of the shaft.

The invention claimed is:

1. A wristwatch timepiece, comprising:

a timepiece transmission coupling for the mechanical linkage of at least one first part of a first shaft at least movable in rotation about a first axis to at least one second part of a second shaft at least movable in rotation about a second axis, the first and second axes being parallel or substantially parallel, the transmission coupling comprising:

the at least one first part of the first shaft, the at least one second part of the second shaft, and at least a first elastic return system, the at least one first elastic return system being arranged so as to limit or cancel out the play between the at least one first part of the first shaft and the at least one second part of the second shaft, and the at least one first elastic return system mechanically connecting the at least one first part of the first shaft and the at least one second part of the second shaft, said at least one elastic return system being configured to urge the first shaft or the second shaft transversely to the axes of the first shaft and the second shaft, said at least one elastic return system including at least one flexible portion that bends around an axis that extends substantially parallel to the axes of the first and second shaft.

2. The wristwatch timepiece having the transmission coupling as claimed in claim 1, wherein the transmission coupling comprises a frame on which is secured the at least one first elastic return system.

3. The wristwatch timepiece having the transmission coupling as claimed in claim 2, wherein the frame comprises the at least one first part of the first shaft and at least one cam surface, designed to cooperate with at least one peg provided on the second shaft, the first elastic return system of the frame comprising at least one elastic blade provided on the at least one cam surface.

4. The wristwatch timepiece having the transmission coupling as claimed in claim 3, wherein the frame comprises N cam surfaces and/or N elastic blades arranged in a symmetry of rotation of order N, with N being an integer greater than or equal to 2, and/or wherein the cam surface or each of the cam surfaces comprises a friction surface.

5. The wristwatch timepiece having the transmission coupling as claimed in claim 1, wherein the transmission coupling comprises a second elastic return system arranged so as to limit or cancel out the play between the at least one first part of the first shaft and the at least one second part of the second shaft, the second return system mechanically connecting the at least one first part of the first shaft and the at least one second part of the second shaft.

6. The wristwatch timepiece having the transmission coupling as claimed in claim 1, wherein the transmission coupling comprises a first sliding element of a first slideway and/or wherein the transmission coupling comprises a second sliding element of a second slideway.

7. The wristwatch timepiece having the transmission coupling as claimed in claim 6, wherein the first sliding element comprises one or several grooves, and/or wherein the second sliding element comprises one or several grooves, and/or wherein the first sliding element comprises at least one friction surface, and/or wherein the second sliding element comprises at least one friction surface.

8. The wristwatch timepiece having the transmission coupling as claimed in claim 1, wherein the transmission coupling comprises a first sliding element of a first slideway and a second sliding element of a second slideway, and wherein the first sliding element and the second sliding element extend, in a direction of the first axis or the second axis or in a direction perpendicular to a third axis of the first slideway and to a fourth axis of the second slideway, overlapping on axial portions.

9. The wristwatch timepiece having the transmission coupling as claimed in claim 1, wherein the at least one first part of the first shaft and the at least one second part of the second shaft extend in a direction of the first axis or in a direction of the second axis, superposed on axial portions.

10. The wristwatch timepiece having the transmission coupling as claimed in claim 1, wherein the at least one first elastic return system comprises one or more first elastic blades and/or wherein the second elastic return system comprises one or more second elastic blades.

11. The wristwatch timepiece having the transmission coupling as claimed in claim 1, wherein the first elastic return system comprises at least one elastically deformable arm and/or wherein a second elastic return system comprises at least one elastically deformable arm.

12. The wristwatch timepiece having the transmission coupling as claimed in claim 11, wherein the transmission coupling comprises a first receiving element and the at least one first elastic return system is arranged so as to be deformed in order to position the first receiving element along the first axis and/or wherein the transmission coupling comprises a second receiving element and the second elastic return system is arranged so as to be deformed in order to position the second receiving element along the second axis.

13. The wristwatch timepiece having the transmission coupling as claimed in claim 1, wherein the at least one first part of the first shaft comprises a second sliding element of the first slideway, and/or wherein the at least one second part of the second shaft comprises a second sliding element of the second slideway.

14. The wristwatch timepiece of claim 1, further comprising:

a geartrain and a display element, the first shaft being in engagement with the gear train and the second shaft being in engagement with the display element.

15. The wristwatch timepiece of claim 1, wherein the transmission coupling further comprises a second elastic return system arranged so as to limit or cancel out the play between the at least one first part of the first shaft and at least one second part of the second shaft, the second return system mechanically connecting the at least one first part of the first shaft and the at least one second part of the second shaft.

16. The wristwatch timepiece of claim 1, wherein:

the at least one elastic return system is configured to independently move both the first shaft and the second shaft transversely to the axes of the first shaft and the second shaft.

17. The wristwatch timepiece of claim 16, wherein:

wherein the elastic return system is configured to independently move both the first conformation and the second conformation transversely to the axes of the first shaft and the second shaft.

18. A wristwatch timepiece, comprising:

a timepiece mechanical linkage element for a transmission coupling, the mechanical linkage element being designed to transmit a movement of rotation from a first shaft to a second shaft, the second shaft being off-center with respect to the first shaft such that an axis of said first shaft and an axis of said second shaft are offset during operation with a spacing between the axes of the first and second shafts, the linkage element comprising:

a first conformation to receive the first shaft;

a second conformation to receive the second shaft; and at least a first elastic return system arranged so as to cooperate with the first or the second receiving conformation, wherein the elastic return system is configured to urge the first conformation or the second conformation transversely to the axes of the first shaft and the second shaft, said elastic return system including at least one member that bends around an axis that extends substantially parallel to the axes of the first and second shaft.

19. The wristwatch timepiece of claim 18, further comprising:

at least one first part of a first shaft, and at least one second part of a second shaft.

20. The wristwatch timepiece of claim 18, wherein:

the first shaft is configured to move relative to the first conformation transversely to the axis of the first shaft, and the second shaft is configured to move relative to the second conformation transversely to the axis of the second shaft.

* * * * *